US007330190B2

(12) United States Patent
Sasaki

(10) Patent No.: US 7,330,190 B2
(45) Date of Patent: Feb. 12, 2008

(54) CORRECTION CHARACTERISTIC DETERMINING DEVICE, CORRECTION CHARACTERISTIC DETERMINING METHOD, AND DISPLAY DEVICE

(75) Inventor: Takashi Sasaki, Taki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 12 days.

(21) Appl. No.: 11/365,689

(22) Filed: Mar. 2, 2006

(65) Prior Publication Data

US 2006/0146066 A1 Jul. 6, 2006

Related U.S. Application Data

(62) Division of application No. 10/315,112, filed on Dec. 10, 2002, now Pat. No. 7,110,001.

(30) Foreign Application Priority Data

Dec. 21, 2001 (JP) ..... 2001-390584
Sep. 13, 2002 (JP) ..... 2002-268599

(51) Int. Cl.
*G09G 5/02* (2006.01)
*G09G 5/10* (2006.01)

(52) U.S. Cl. ..... 345/590; 345/690

(58) Field of Classification Search ..... 345/590
See application file for complete search history.

(56) References Cited

U.S. PATENT DOCUMENTS 5,654,607 A 8/1997 Yamaguchi et al.
6,125,200 A 9/2000 Warnock
6,480,202 B1 11/2002 Deguchi et al.
2001/0050757 A1 12/2001 Yoshida et al.
2003/0142110 A1 7/2003 Murashita

FOREIGN PATENT DOCUMENTS

DE 101 22 949 11/2001
JP 5-127620 A 5/1993
JP 07-005836 1/1995
KR 1999-25691 7/1999

OTHER PUBLICATIONS

U.S. Appl. No. 10/315,112, filed Dec. 10, 2002.
Korean Office Action mailed Apr. 8, 2005 (w/English translation thereof).

*Primary Examiner*—Kee M. Tung
*Assistant Examiner*—Aaron M. Richer
(74) *Attorney, Agent, or Firm*—Nixon & Vanderhye P.C.

(57) ABSTRACT

A correction characteristic determining device for (a) converting measured data, indicative of an emission condition of a liquid crystal panel, into brightness data of three primary colors by using a conversion matrix, and (b) determining the correction characteristic in accordance with a conversion result obtained by (a). The device may in certain example embodiments may set a target curve indicative of a relationship between a grey (or gray) scale value of an image signal and target output brightness. An adjustment parameter may be set by subtracting an actual brightness value from a lowest target output brightness in certain example embodiments. A relationship may be determined between a non-corrected grey scale value and a corrected grey scale value in accordance with the target curve that has been adjusted based at least on the adjustment parameter.

11 Claims, 18 Drawing Sheets

FIG. 16

| GRAY SCALE i | GRAY SCALE VALUE I(i) | Yo(i) (%) |
|---|---|---|
| 0 | 0 | 0.00 |
| 1 | 1 | 0.00 |
| 2 | 2 | 0.00 |
| 3 | 3 | 0.01 |
| 4 | 4 | 0.01 |
| 5 | 6 | 0.03 |
| 6 | 8 | 0.05 |
| 7 | 10 | 0.08 |
| 8 | 12 | 0.12 |
| 9 | 14 | 0.17 |
| 10 | 16 | 0.23 |
| 11 | 20 | 0.37 |
| 12 | 24 | 0.55 |
| 13 | 28 | 0.78 |
| 14 | 32 | 1.04 |
| 15 | 36 | 1.35 |
| 16 | 40 | 1.70 |
| 17 | 44 | 2.10 |
| 18 | 48 | 2.54 |
| 19 | 52 | 3.03 |
| 20 | 56 | 3.56 |
| 21 | 60 | 4.15 |
| 22 | 64 | 4.78 |
| 23 | 68 | 5.46 |
| 24 | 72 | 6.19 |
| 25 | 76 | 6.97 |
| 26 | 80 | 7.81 |
| 27 | 84 | 8.69 |
| 28 | 88 | 9.63 |
| 29 | 92 | 10.62 |
| 30 | 96 | 11.66 |
| 31 | 100 | 12.75 |

| GRAY SCALE I | GRAY SCALE VALUE I(i) | Yo(i) (%) |
|---|---|---|
| 32 | 104 | 13.90 |
| 33 | 108 | 15.11 |
| 34 | 112 | 16.36 |
| 35 | 116 | 17.68 |
| 36 | 120 | 19.05 |
| 37 | 124 | 20.47 |
| 38 | 128 | 21.95 |
| 39 | 136 | 25.08 |
| 40 | 144 | 28.45 |
| 41 | 152 | 32.04 |
| 42 | 160 | 35.87 |
| 43 | 168 | 39.93 |
| 44 | 176 | 44.23 |
| 45 | 184 | 48.78 |
| 46 | 192 | 53.56 |
| 47 | 196 | 56.05 |
| 48 | 200 | 58.60 |
| 49 | 204 | 61.21 |
| 50 | 208 | 63.88 |
| 51 | 212 | 66.61 |
| 52 | 216 | 69.41 |
| 53 | 220 | 72.27 |
| 54 | 224 | 75.19 |
| 55 | 228 | 78.18 |
| 56 | 232 | 81.22 |
| 57 | 236 | 84.34 |
| 58 | 240 | 87.51 |
| 59 | 244 | 90.75 |
| 60 | 248 | 94.06 |
| 61 | 252 | 97.43 |
| 62 | 254 | 99.14 |
| 63 | 255 | 100.00 |

CORRECTION CHARACTERISTIC DETERMINING DEVICE, CORRECTION CHARACTERISTIC DETERMINING METHOD, AND DISPLAY DEVICE

This application is a Divisional of application Ser. No. 10/315,112, filed Dec. 10, 2002 now U.S. Pat. No. 7,110,001, the entire content of which is hereby incorporated herein by reference in this application.

FIELD OF THE INVENTION

The present invention relates to a correction characteristic determining device and a correction characteristic determining method for determining a correction characteristic of correction performed with respect to an image signal so as to improve display quality of a liquid crystal panel and the like, and relates to a display device whose correction characteristic is determined by the correction characteristic determining method.

BACKGROUND OF THE INVENTION

Recently, various kinds of a color liquid crystal display device (liquid crystal color display) have been developed and have been on sale. In order to improve the display quality of a liquid crystal panel, the liquid crystal display device is provided with a γ correction device for performing y correction with respect to an image signal to be inputted. Further, it is required to provide a correction characteristic determining device which can appropriately determine a correction characteristic of the γ correction.

Conventionally, as to a technique concerning the γ correction of the liquid crystal display device, Japanese Unexamined Patent Publication No. 127620/1993 (Tokukaihei 5-127620)(Publication date: May 25, 1993) discloses the following technique. In a projection-type liquid crystal display device, brightness and chromaticity of an actually projected image are measured, and the γ correction is performed while adjusting white balance to target chromaticity.

However, in the technique disclosed in Tokukaihei 5-127620, a target mixture ratio of RGB is calculated, in accordance with (a) the target chromaticity that has been set in advance and (b) actually measured chromaticity, while adjusting the white balance, but characteristics of respective display devices are not taken into consideration upon calculating the mixture ratio of RGB. More concretely, in the technique disclosed in the foregoing publication, the target mixture ratio of RGB is calculated by using chromaticity obtained in a case where each color of RGB is projected as a single color, but chromaticity obtained in a case of white display is not taken into consideration, so that the target mixture ratio of RGB is calculated without considering brightness difference etc. among RGB in an actual display device.

Thus, in the technique disclosed in the foregoing publication, even though display is subjected to the correction, the actual mixture ratio of RGB deviates from the target mixture ratio of RGB due to difference in the characteristics of the respective display devices.

Further, in the technique disclosed in the foregoing publication, a characteristic of a black state at a low gray scale area of the liquid crystal display is not taken into consideration, so that a target curve (curved line indicative of a target value of output brightness with respect to a gray scale value) sometimes indicates indisplayable brightness (a value at which the display cannot be performed in the liquid crystal element) as shown in FIG. 10(*a*).

For example, even when a target value indicated by the target curved is 0 at the lowest gray scale area, a bit of brightness and a bit of chromaticity are sometimes obtained in a case where the lowest gray scale is actually displayed in the liquid crystal element so that the brightness and chromaticity thereof are measured. Thus, the target value "0" is a indisplayable value at which display cannot be performed in the liquid crystal element, and it is necessary to adjust the target value at the low gray scale area so as to set the target value to be displayable.

Further, upon adjusting the target value at the low gray scale area, in a case where the target value at the low gray scale area that has been adjusted as shown in FIG. 10(*b*) does not smoothly shift to a target value of a middle-high gray scale that has not been adjusted (a case shown in FIG. 10(*c*)), the brightness and chromaticity greatly vary in the vicinity of the foregoing gray scale in the display device having been subjected to the adjustment, so that this sometimes causes a low quality image.

SUMMARY OF THE INVENTION

The present invention was made from the view point of these conventional problems, and its object is to provide a correction characteristic determining device and a correction characteristic determining method for matching a correction characteristic of a display device, which corrects an image signal so as to display an image in display means, to a characteristic of the display means. Further, the present invention is to provide a display device whose correction characteristic is determined by the correction characteristic determining method.

The correction characteristic determining device according to the present invention determines a correction characteristic in a display device which corrects an image signal constituted of three primary color signals, and displays a color image in display means in accordance with thus corrected image signal, and said correction characteristic determining device includes: data converting means for converting measured data, convertible into a tristimulus value, that indicates a result of measurement performed with respect to an emission condition of display in the display means, into brightness data of three primary colors, by using a conversion matrix; correction characteristic determining means for determining the correction characteristic in accordance with a conversion result obtained by the data converting means; and matrix generating means for generating the conversion matrix, wherein said matrix generating means includes: matrix element generating means for generating a matrix element of an inverse matrix of the conversion matrix, in accordance with measured data obtained when the display means displays highest gray scales of respective primary colors; matrix element adjusting means for adjusting a matrix element that has been generated by the matrix element generating means in accordance with measured data obtained when the display means displays a highest gray scale of white; and inverse matrix generating means for generating an inverse matrix of a matrix constituted of the matrix element that has been adjusted.

According to the arrangement, the measured data is converted into the brightness data of the three primary colors in the form of the tristimulus value by the data converting means, so that it is possible to grasp the characteristic of the display means of the display device in the form of the brightness data of the primary three colors. In the correction characteristic determining means, it is possible to determine the desired correction characteristic in accordance with the brightness data of the three primary colors.

Note that, the measured data is data, convertible into the tristimulus value, that indicates the result of measurement performed with respect to the emission condition in display of the display means, and the measured data can be obtained by using measuring means such as brightness/chromaticity meter. Further, "data convertible into the tristimulus value" may be a tristimulus value such as X, Y, and Z of a XYZ color system, or may be a value correlating with the tristimulus value like Y, x, and y of a Yxy color system.

Further, the correction characteristic is determined as a relationship between a gray scale of the image signal and a value (target output brightness) appropriate as an actual output brightness in the display means when the gray scale is inputted to the display device.

Here, the conversion matrix used for the data conversion in the data converting means is generated by the matrix generating means. The matrix generating means causes the matrix element generating means, the matrix element adjusting means, and the inverse matrix generating means to generate the conversion matrix.

The matrix element generating means can generate the matrix element of the inverse matrix of the conversion matrix in accordance with Expression 1 of the embodiment which is satisfied by using the measured data obtained when the display means displays highest gray scales of the respective primary colors.

The matrix element adjusting means can adjust the matrix element so that the matrix element matches with the characteristic of the display means by carrying out the following processes: Expression 2 of the embodiment is made by using the matrix element generated by the matrix element generating means, and the measured data obtained when the display means displays the highest gray scale of white is substituted in Expression 2 so as to generate Expression 3, and the generated Expression 3 is solved.

The inverse matrix generating means can generate the conversion matrix by generating the inverse matrix of a matrix constituted of the matrix element that has been adjusted by the matrix element adjusting means.

In this manner, the matrix generating means generates the conversion matrix which matches with the characteristic of the display means, so that it is possible to cause the data converting means to properly perform the data conversion. As a result, it is possible to inhibit overflows and conversion errors etc. brought about upon data conversion. Thus, it is possible to cause the correction characteristic determining means to determine the correction characteristic more accurately.

Further, the correction characteristic determining device according to the present invention determines a correction characteristic of a display device which corrects an image signal, and displays an image in display means in accordance with thus corrected image signal, and in order to achieve the foregoing object, said correction characteristic determining device includes: target curve setting means for setting a target curve indicative of a relationship between a gray scale value of the image signal that has not been corrected and target output brightness, corresponding to the gray scale value, that should be displayed in the display means; gray scale adjusting means for setting an adjustment parameter by subtracting an actual brightness value, obtained when the display means displays a lowest gray scale, from lowest target output brightness corresponding to a lowest gray scale value of the image signal in the target curve, and for adjusting the target curve by subtracting the adjustment parameter from at least target output brightness in the target curve which is less than the lowest target output brightness; and gray scale value converting means for determining a relationship between the gray scale value, that has not been corrected, and the gray scale value, that has been corrected, in the image signal, in accordance with the target curve that has been adjusted by the gray scale adjusting means.

According to the arrangement, a characteristic of lowest gray scale display (black state) in the display means is taken into consideration so as to adjust the target output brightness, so that it is possible to avoid a condition under which the target output brightness actually indisplayable in the display means is set. At this time, according to the arrangement, it is possible to set the lowest target output brightness, corresponding to the lowest gray scale, to the lowest output brightness actually displayable in the display means. Thus, it is possible to efficiently use a low gray scale area actually displayable in the display means, and to avoid a condition under which the target output brightness actually indisplayable in the display means is set.

Note that, each of the correction characteristic determining devices according to the present invention can be regarded also as a correction characteristic determining method. Also in the following correction characteristic determining method, it is possible to obtain the same effects as in the foregoing correction characteristic determining devices.

That is, the correction characteristic determining method according to the present invention determines a correction characteristic in a display device which corrects an image signal constituted of three primary color signals, and displays a color image in display means in accordance with thus corrected image signal, and in order to achieve the foregoing object, said method includes the steps of: (i) converting measured data, convertible into a tristimulus value, that indicates a result of measurement performed with respect to an emission condition of display in the display means, into brightness data of three primary colors, by using a conversion matrix; (ii) determining the correction characteristic in accordance with a conversion result obtained by the step (i); and (iii) generating the conversion matrix before performing the step (i), wherein the step (iii) includes the steps of: (iii-a) generating a matrix element of an inverse matrix of the conversion matrix, in accordance with measured data obtained when the display means displays highest gray scales of respective primary colors; (iii-b) adjusting a matrix element that has been generated by the step (iii-a) in accordance with measured data obtained when the display means displays a highest gray scale of white; and (iii-c) generating an inverse matrix of a matrix constituted of the matrix element that has been adjusted.

Further, the display device according to the present invention corrects an image signal constituted of three primary color signals, and displays a color image in display means in accordance with thus corrected image signal, wherein a correction characteristic is determined by the respective correction characteristic determining methods.

In the display device, it is possible to determine the correction characteristic properly in accordance with the respective correction characteristic determining methods, so that it is possible to realize high quality display.

The correction characteristic determining method according to the present invention corrects an image signal constituted of three primary color signals, and displays a color image in display means in accordance with thus corrected image signal, wherein said method includes the steps of: (I) setting a target curve indicative of a relationship between a gray scale value of the image signal that has not been corrected and target output brightness that should be displayed in the display means; (II) setting an adjustment parameter by subtracting an actual brightness value, obtained when the display means displays a lowest gray scale, from lowest target output brightness corresponding to a lowest gray scale value of the image signal in the target curve, so as to adjust the target curve by subtracting the adjustment parameter from at least target output brightness in the target curve which is less than the lowest target output brightness; and (III) determining a relationship between the gray scale value, that has not been corrected, and the gray scale value, that has been corrected, in the image signal, in accordance with the target curve that has been adjusted by the step (II).

Further, the display device according to the present invention corrects an image signal, and displays an image in display means in accordance with thus corrected image signal, wherein a correction characteristic is determined by the correction characteristic determining methods.

In the display device, it is possible to determine the correction characteristic properly in accordance with the respective correction characteristic determining methods, so that it is possible to realize high quality display.

For a fuller understanding of the nature and advantages of the invention, reference should be made to the ensuing detailed description taken in conjunction with the accompanying drawings.

BRIEF DESCRIPTION OF THE DRAWINGS

FIG. 16 is a table showing a relationship among a gray scale, a gray scale value, and target brightness.

DESCRIPTION OF THE EMBODIMENTS

An embodiment of the present invention is described as follows based on FIG. 1 through FIG. 18.

1. Whole Arrangement

Figure 2:
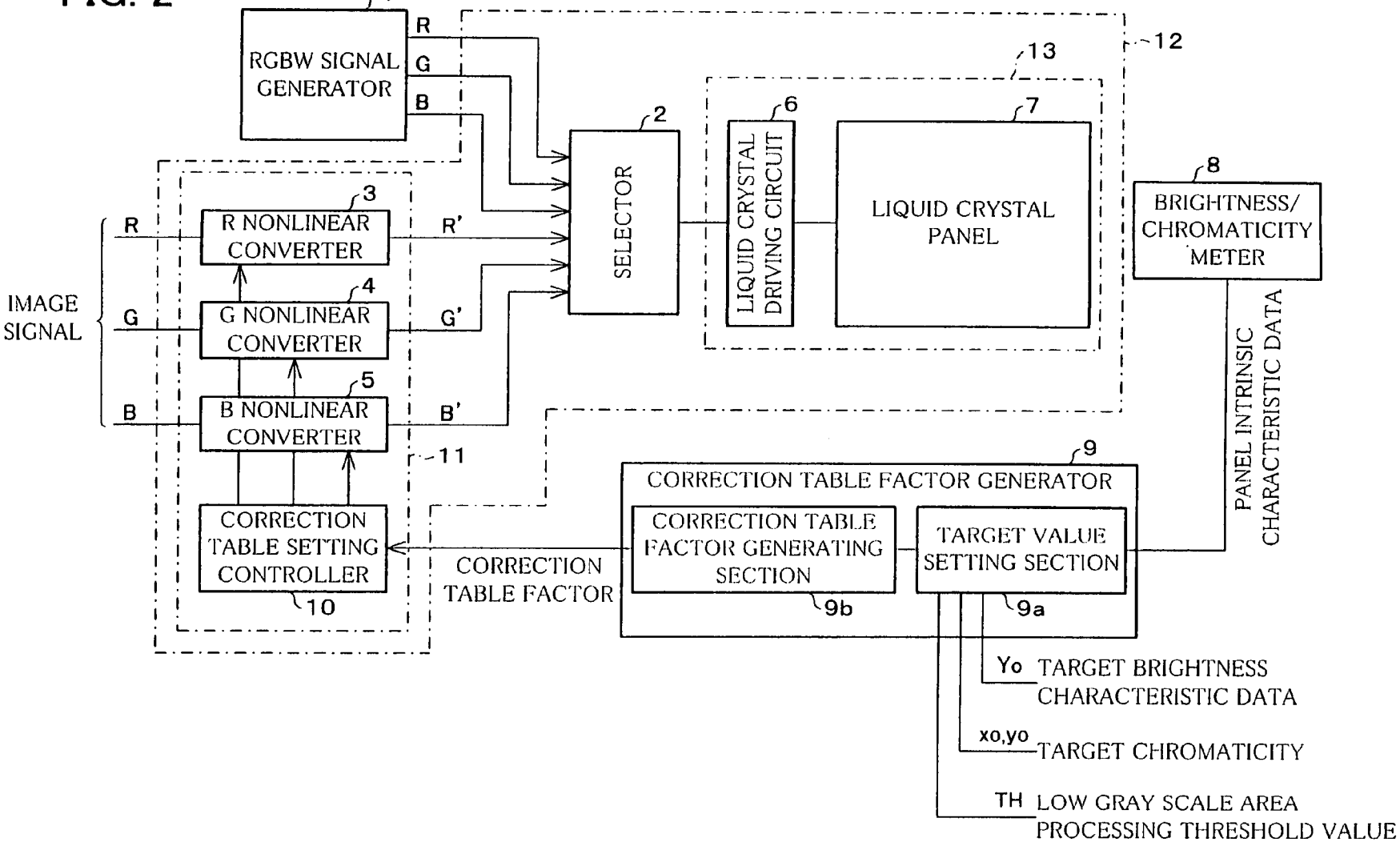
FIG. 2 is a block diagram showing (a) a liquid crystal display device provided with a y correction device according to the embodiment of the present invention, and (b) peripheral devices (signal generator, brightness/chromaticity meter, correction table factor generator) for setting the correction table of the γ correction device.

FIG. 2 is a block diagram showing a liquid crystal display device 12 provided with a γ correction device 11 according to the present embodiment and peripheral devices for setting a correction table of the γ correction device 11. The liquid crystal display device 12 includes a γ correction device 11, a display component 13, and a selector (input selector) 2. The γ correction device 11 includes an R nonlinear converter 3, a G nonlinear converter 4, a B nonlinear converter 5 (RGB nonlinear converters 3 to 5), and a correction table setting controller 10. The display component 13 includes a liquid crystal circuit 6 and a liquid crystal panel 7. The peripheral devices are a signal generator 1 (RGBW signal generator), a brightness/chromaticity meter 8, and a correction table factor generator 9.

The correction table of the γ correction device 11 is set before shipping the liquid crystal display device 12 at the factory. At this time, the correction table is set in the correction table setting controller 10. After setting the correction table, the signal generator 1 and the correction table factor generator 9 are separated from the liquid crystal display device 12 before shipping the liquid crystal display deice 12 at the factory.

Here, each of image signals of RGB that are inputted to the liquid crystal display device 12 is 8 bit data (for 256 gray scales ranging from 0 to 255 gray scale), and the display component 13 can perform display for 256 gray scales. Each of the RGB nonlinear converters 3 to 5 is to convert the inputted image signal into a signal suitable for a γ characteristic of the liquid crystal panel 7 (γ correction). This converter performs the conversion for 64 gray scales, a predefined sampling point of 0 to 255 gray scale, corresponding to the γ characteristic of the liquid crystal panel 7, and performs interpolation etc. with respect to other gray scales in accordance with the foregoing 64 gray scales so that they are used as data that has been converted.

A gray scale i for the 64 gray scales is made to correspond to a gray scale value I (i) of the 256 gray scales as shown in FIG. 16 for example. Note that, hereinbelow, "gray scale"

means a value for the 64 gray scales, and "gray scale value" means a value for the 255 gray scales.

Figure 15:
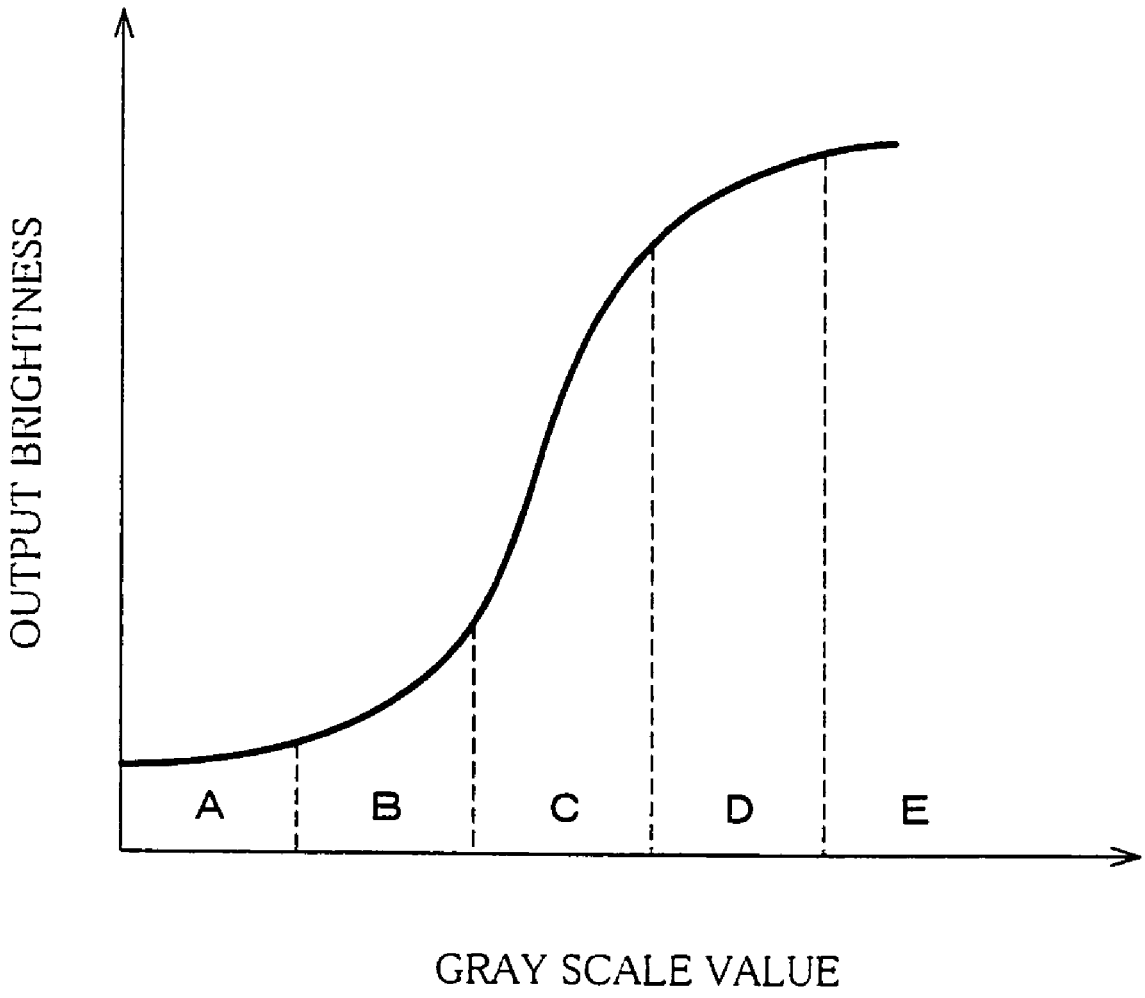
FIG. 15 is a graph showing a V-T characteristic of a liquid crystal panel.

The correspondence between the gray scale i and the gray scale value I (i) is set as follows. FIG. 15 shows a V-T characteristic of the liquid crystal panel 7 (a characteristic of transmittance (T) with respect to an applied voltage (V) in the liquid crystal panel 7, the transmittance can be regarded as the brightness), that has not been subjected to the γ correction, in a case where the gray scale value (relative to a voltage applied to the liquid crystal) is inputted. Here, at an A area and an E area of FIG. 15, the output brightness hardly varies regardless of the variation of the gray scale value, so that it is preferable that: the gray scale value I (i) (sampling point) employed as the gray scale i is largely taken, and the gray scale is set in a minute manner. Adversely, at an area where the output brightness largely varies corresponding to the variation of the gray scale value like a C area, the gray scale value I (i) (sampling point) is small taken. In this manner, it is possible to set the gray scale i as follows: the sampling point is largely taken at the low gray scale area and the high gray scale area, and the sampling point is small taken at the middle gray scale as shown in FIG. 16. Note that, the gray scale I (0) corresponding to 0 gray scale which is the lowest gray scale is set to be 0 which is the lowest gray scale value, and the gray scale I (63) corresponding to 63 gray scale which is the highest gray scale is set to be 255 which is the highest gray scale value.

When the correction table is set, the signal generator 1 outputs signals of (a) RGB highest gray scales, (b) a white (W) gray scale, and (c) gray scales (0 to 62 gray scales) other than W, so as to measure an intrinsic characteristic of the liquid crystal panel 7. Here, "the intrinsic characteristic of the liquid crystal panel 7" means the V-T characteristic of the liquid crystal panel 7 that has not been subjected to the correction. Further, "R highest gray scale" means that: R is the highest gray scale, and G and B are the lowest gray scales. Likewise, "G highest gray scale" means that: G is the highest gray scale, and B and R are the lowest gray scales, and "B highest gray scale" means that: B is the highest gray scale, and R and G are the lowest gray scales. Further, "W highest gray scale" means that all the RGB are the highest gray scale.

Next, a signal outputted from the signal generator 1 is selected by the selector 2, and is inputted to the liquid crystal driving circuit 6, and display according to the signal is performed in the liquid crystal panel 7. The brightness/chromaticity meter 8 measures the display in the liquid crystal panel 7, and panel intrinsic characteristic data indicative of the result is transmitted to the correction table factor generator 9. The correction table factor generator 9 generates the correction table factor in accordance with (a) the panel intrinsic characteristic data, (b) target brightness characteristic data Yo inputted from the outside, (c) target chromaticity xo, yo, and (d) a low gray scale area processing threshold value TH. Then, the correction table factor is transmitted to the correction table setting controller 10.

FIG. 16 is a table showing an example of the target brightness characteristic data Yo. The target brightness characteristic data Yo is data to set the target value of the brightness (target brightness) of each gray scale. FIG. 16 shows a relationship among (a) the gray scale i in a case where γ=2.2, (b) the gray scale value I (i) corresponding to each gray scale, and (c) the target brightness Yo (i) of each gray scale (relative value in a case where the brightness for 63 gray scales is 100%). In this manner, the target brightness Yo (i) indicates a value of the i gray scale of the target γ curve. Note that, the relationship between the gray scale i and the gray scale value I (i) of FIG. 16 is set by the correction table setting controller 10 for example, and can be referred to also in the correction table factor generator 9.

The target chromaticity xo and yo are values to adjust the white balance. The target chromaticity xo and yo are respectively an x value and a y value in a Yxy color system under a condition under which the white balance is appropriately adjusted in all the gray scales of W except the low gray scale area described later.

Further, the low gray scale area processing threshold value TH is a threshold value to determine how many gray scales should be regarded to be within the low gray scale area.

The correction table setting controller 10 stores the correction table factor, and transmits the correction table factor, stored upon actually displaying an image, to the RGB nonlinear converters 3 to 5. Each of the RGB nonlinear converters 3 to 5 performs nonlinear conversion with respect to RGB image signals, inputted upon actually displaying an image, in accordance with the correction table factor, and transmits the image signal, that has been converted, to the liquid crystal driving circuit 6. When an image is actually displayed, the selector 2 selects the image signals from the RGB nonlinear converters 3 to 7, and transmits the image signals to the liquid crystal driving circuit 6. Thus, display is performed in the liquid crystal panel 7 in accordance with the image signals that have been converted.

2. Processing Flow in Correction Table Factor Generator

Figure 3:
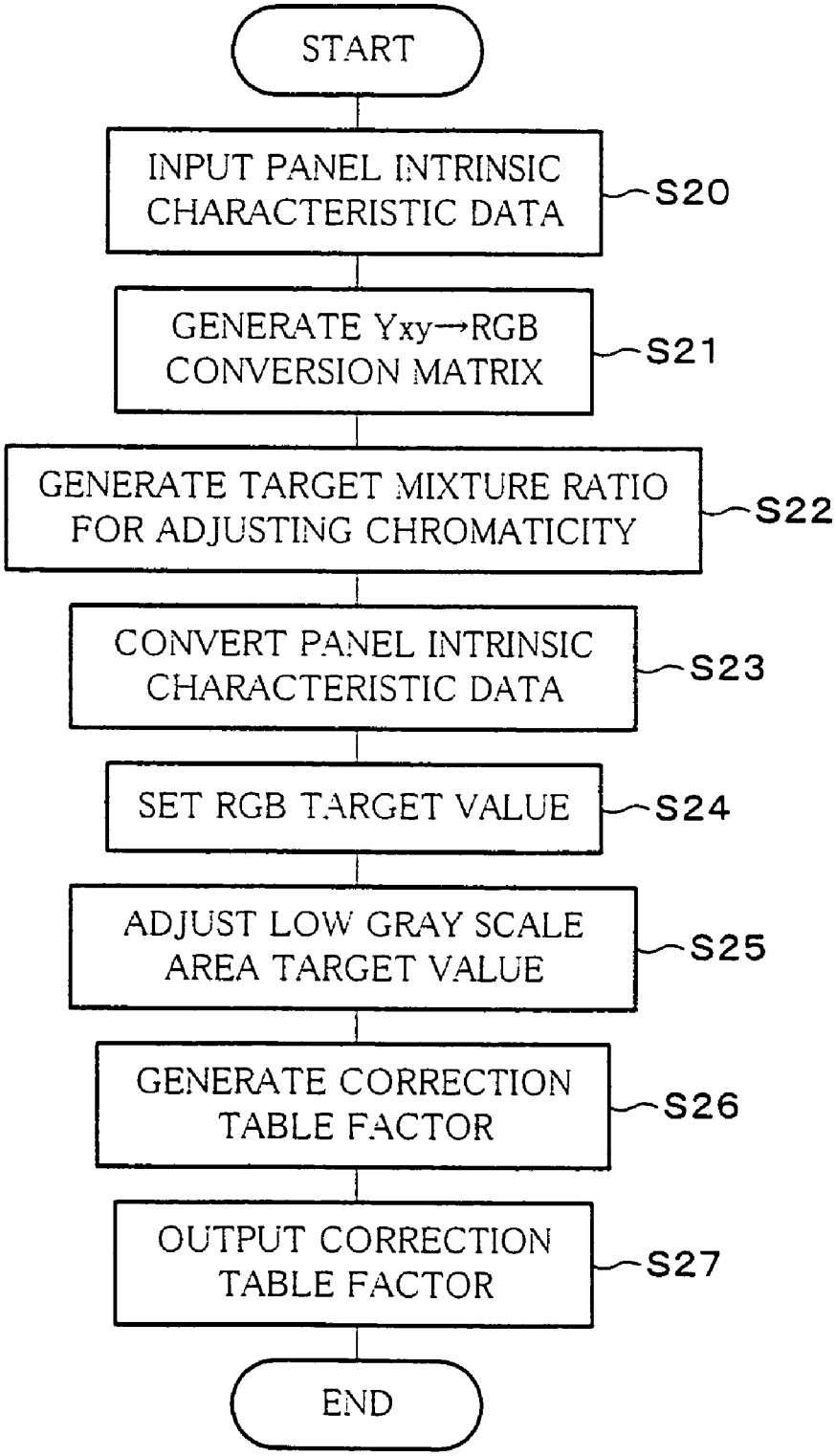
FIG. 3 is a flow chart showing a processing flow in the correction table factor generator of FIG. 2.

FIG. 3 is a flow chart showing a processing flow in the correction table factor generator 9. First, data of values, that have been measured by the brightness/chromaticity meter 8 when RGB highest gray scales and 0 to 63 gray scale of W are displayed, are inputted as the panel intrinsic characteristic data from the brightness/chromaticity meter 8 (step S 20). The data is Yxy color system data constituted of the brightness and the chromaticity. Here, the Yxy color system is a color system proposed by CIE (International Commission on Illumination), and Y indicates the brightness, and x and y indicate the chromaticity. Further, a relationship between the Yxy color system and an XYZ color system described later is X:Y:Z=x:y:1−x−y, Y=Y. In the present embodiment, description is given on a case where the Yxy color system data is obtained as the data of values measured by the brightness/chromaticity meter 8. However, the present invention is not limited to the case where the panel intrinsic characteristic data is the Yxy color system data, but may be applied to a case where the panel intrinsic characteristic data is other color system data such as the XYZ color system data.

Next, in accordance with the data inputted in step S 20, the following conversion matrix is generated: the conversion matrix is to convert the Yxy color system data into RGB color system data, and matches with the panel characteristic of the liquid crystal panel 7 (step S21).

Next, in accordance with (a) the conversion matrix generated in step S21 and (b) the target chromaticity xo and yo that has been set in advance, the target mixture ratio of RGB to adjust the chromaticity is generated (step S22).

Next, by using the conversion matrix generated in step S21, the Yxy color system data inputted in step S20 is converted into the RGB color system data (step S23).

Next, in accordance with (a) the target mixture ratio generated in step S22, (b) the data converted in step S23, and (c) the target brightness characteristic data Yo that has been set in advance, the target value in each gray scale of each color of RGB is set (step S24).

Next, in accordance with (a) the data converted in step S23, (b) the target value set in step S24, and (c) the low gray scale area processing threshold value TH, the target value of the low gray scale area is adjusted (step S25).

Further, in accordance with (a) the target values set in steps S21 to S24 and (b) the panel intrinsic characteristic, the correction table factor is generated (step S26), and the correction table factor is outputted (step S27).

3. Target Value Setting Section

Figure 1:
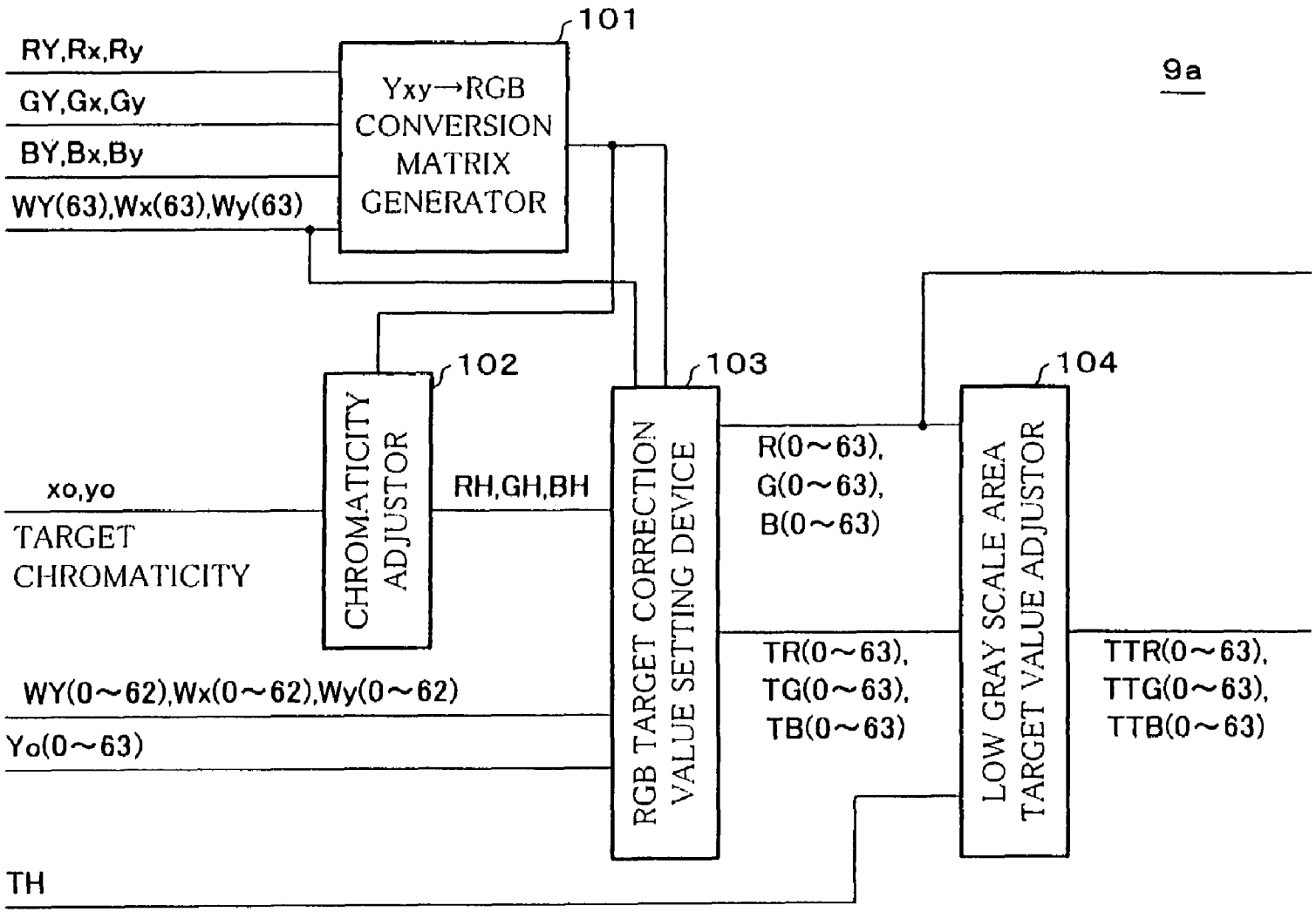
FIG. 1 is a block diagram showing an arrangement of a target value setting section of a correction table factor generator according to an embodiment of the present invention.

In the correction table factor generator 9, a portion for performing the processes of steps S21 to S25 is referred to as a target value setting section 9*a*, and a portion for performing the process of step S26 is referred to as a correction table factor generating section (correction value adjustor) 9*b* (see FIG. 1). An arrangement of the target value setting section 9*a* is described as follows based on FIG. 1 and FIGS. 4 to 11.

Figure 4:
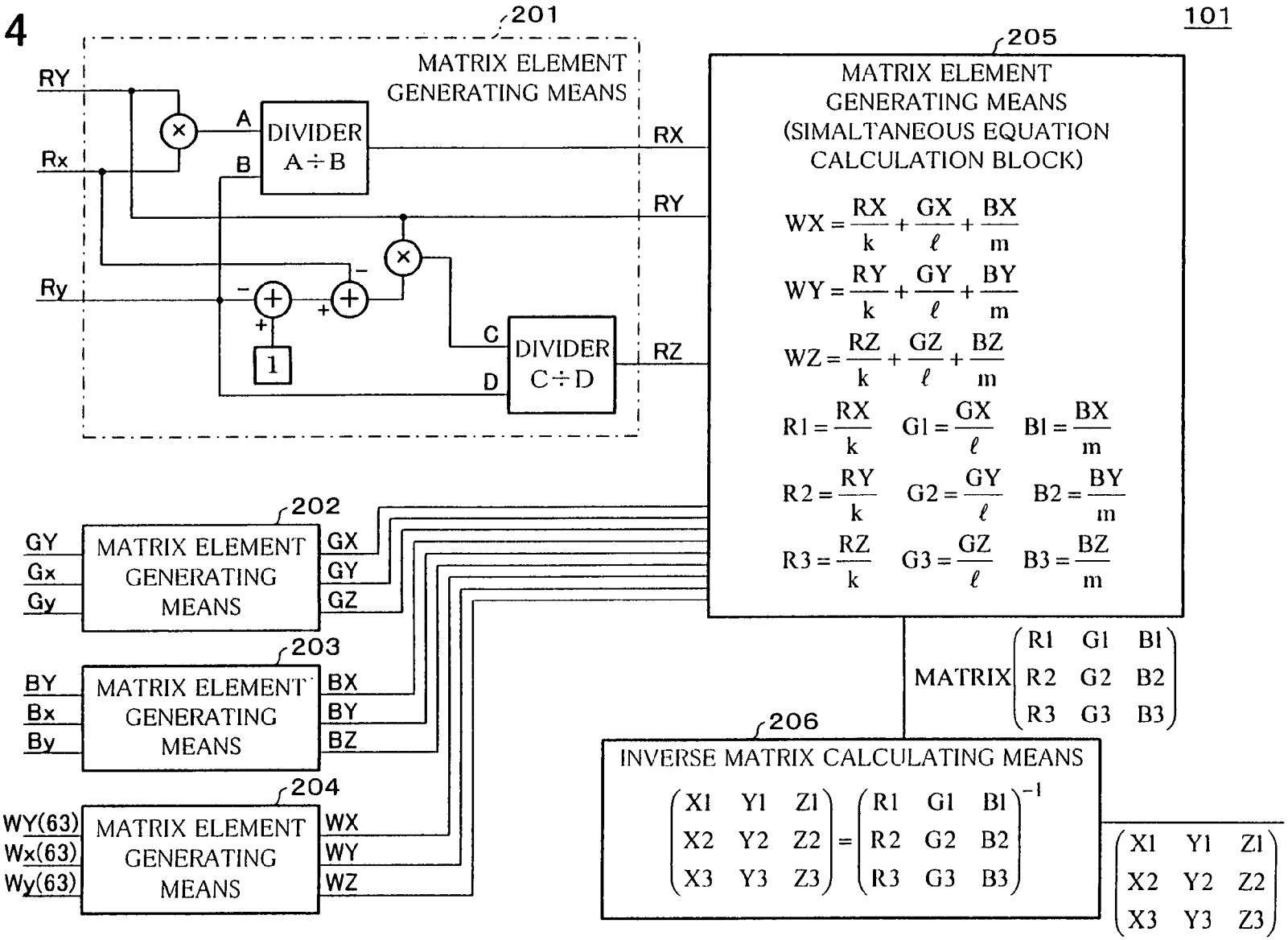
FIG. 4 is a block diagram showing an arrangement of a conversion matrix generator included in the target value setting section of FIG. 1.
Figure 5:
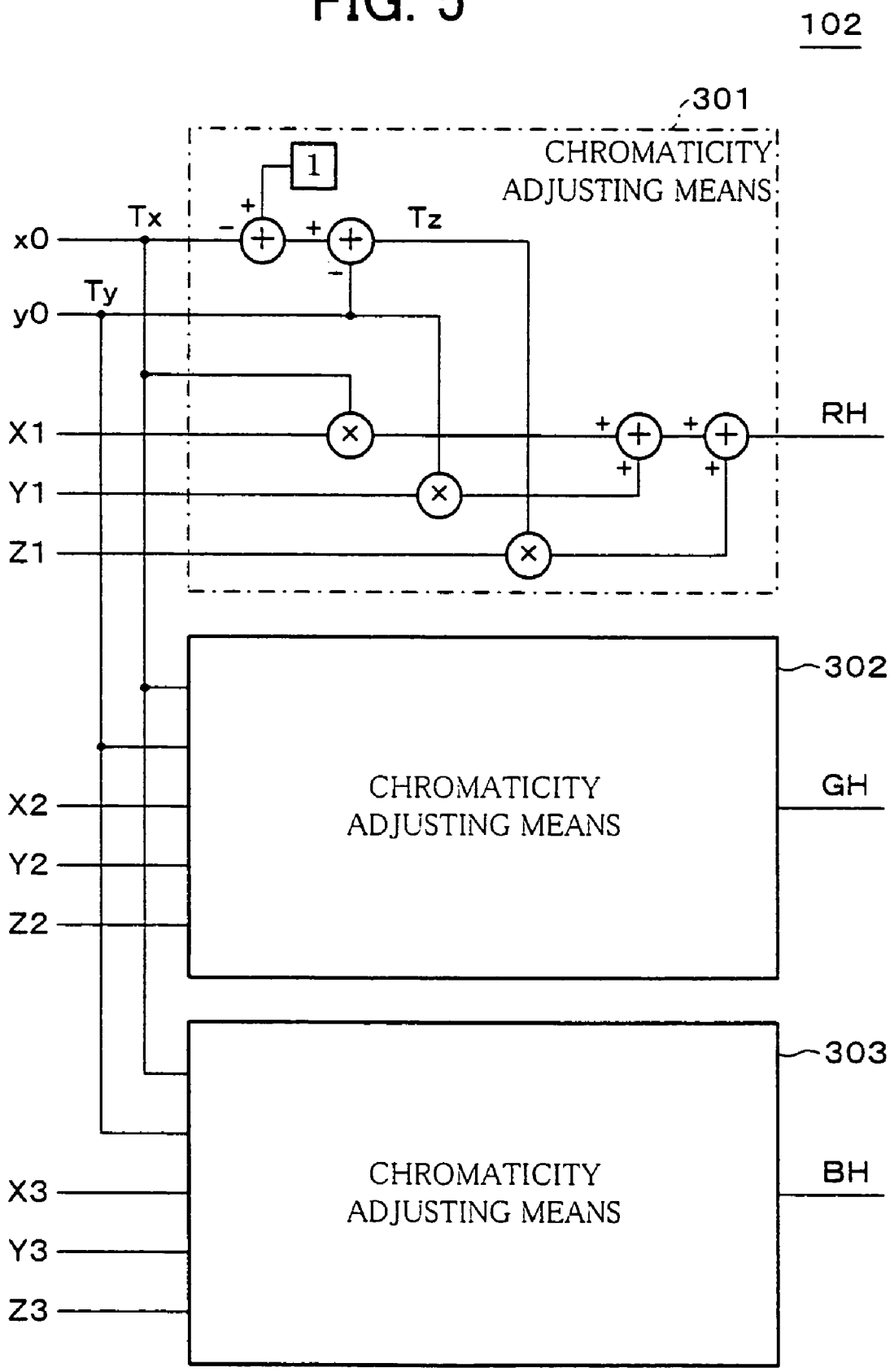
FIG. 5 is a block diagram showing an arrangement of a chromaticity adjustor included in the target value setting section of FIG. 1.
Figure 6:
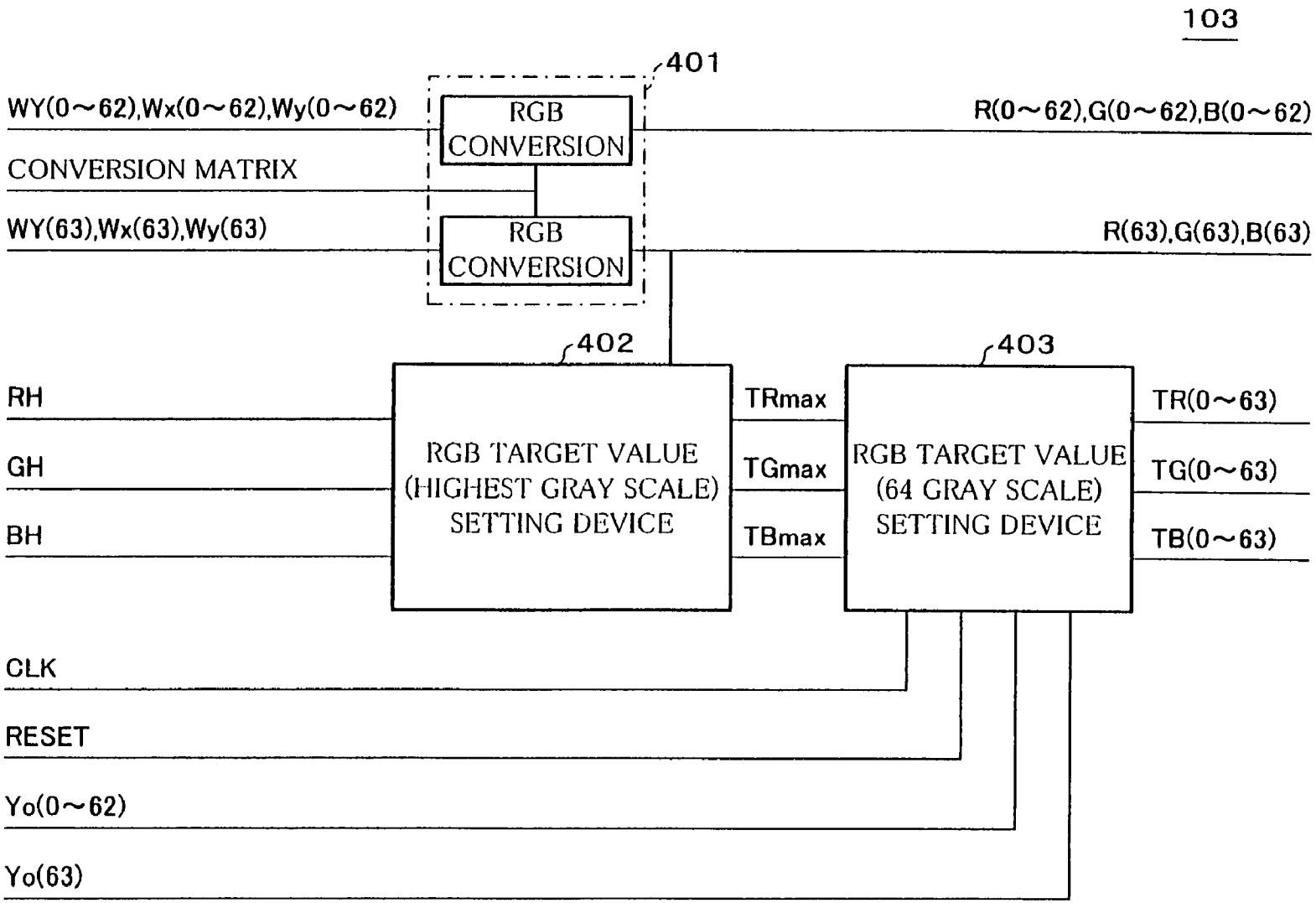
FIG. 6 is a block diagram showing an arrangement of an RGB target correction value setting device included in the target value setting section of FIG. 1.
Figure 11:
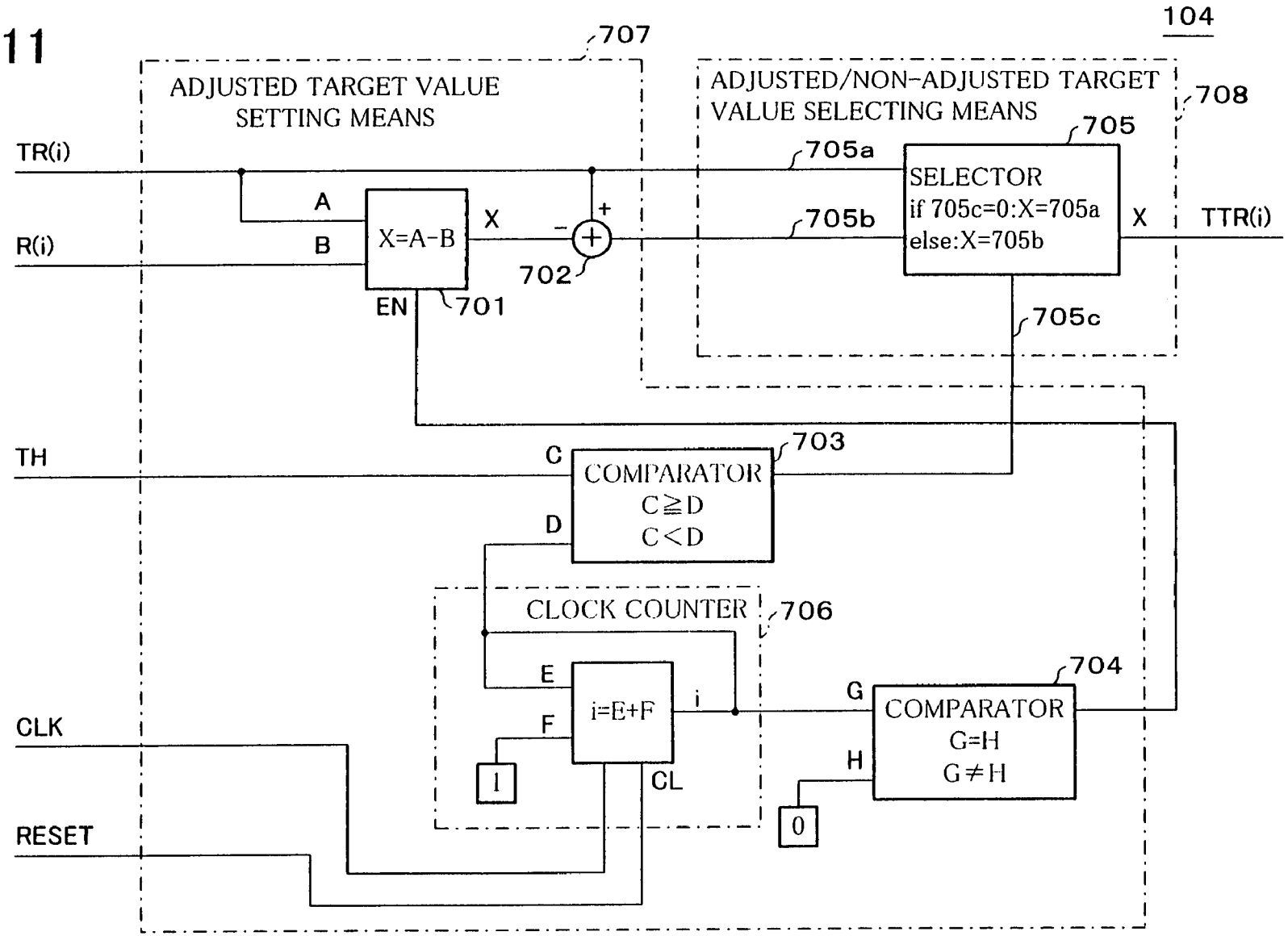
FIG. 11 is a block diagram showing an arrangement of the low gray scale area target value adjustor included in the target value setting section of FIG. 1.

FIG. 1 is a block diagram showing an arrangement of the target value setting section 9*a*. The target value setting section 9*a* includes: a conversion matrix generator 101 (Yxy→RGB conversion matrix generator); the chromaticity adjustor 102; the RGB target correction value setting device 103; and the low gray scale area target value adjustor 104. Each of FIGS. 4 to 6 and FIG. 11 is a block diagram, and FIG. 4 shows an arrangement of the conversion matrix generator 101, and FIG. 5 shows an arrangement of the chromaticity adjustor 102, and FIG. 6 shows an arrangement of the RGB target correction value setting device 103, and FIG. 11 shows an arrangement of the low gray scale area target value adjustor 104.

The panel intrinsic characteristic data upon displaying each highest gray scale is inputted to the conversion matrix generator 101. Here, when the R highest gray scale is displayed in the liquid crystal panel 7 by means of the signal generator 1, values measured by the brightness/chromaticity 8 are indicated as follows: the brightness is indicated as RY, and the chromaticity is indicated as Rx and Ry. Values in a case where the G highest gray scale is displayed in the same manner are indicated as follows: the brightness is indicated as GY, and the chromaticity is indicated as Gx and Gy. Values in a case where the B highest gray scale is displayed are indicated as follows: the brightness is indicated as BY, and the chromaticity is indicated as Bx and By. Values in a case where the W highest gray scale is displayed in the same manner is indicated as follows: the brightness is indicated as WY (63), and the chromaticity is indicated as Wx (63) and Wy (63).

Further, the chromaticity xo and yo is inputted to the chromaticity adjustor 102. The panel intrinsic characteristic data upon displaying each gray scale of W and the target brightness Yo (0 to 63) are inputted to the RGB target correction value setting device 103. Here, when i gray scale (i is an arbitrary integer from 0 to 63) of W is displayed in the liquid crystal panel 7 by means of the signal generator 1, values measured by the brightness/chromaticity 8 are indicated as follows: the brightness is indicated as WY (i), and the chromaticity is indicated as Wx (i) and Wy (i). Note that, WY (0 to i) means WY (0), WY (1), . . . , WY (i) (this is the same as to Wx and Wy).

Further, the low gray scale area processing threshold value TH is inputted to the low gray scale area target value adjustor 104.

The conversion matrix generator 101 generates the conversion matrix in step S21 of FIG. 3. The conversion matrix that has been generated in the conversion matrix generator 101 is inputted to the chromaticity adjustor 102 and the RGB target correction value setting device 103. The chromaticity adjustor 102 generates target mixture ratios RH, GH, and BH of RGB so as to adjust the chromaticity in accordance with (a) the target chromaticity xo and yo and (b) the conversion matrix in step S22. The RGB target correction value setting device 103 converts the panel characteristic data, ranging from 0 to 63 gray scale of W, from the Yxy color system to the RGB color system by using the conversion matrix in step S22, and outputs R (0 to 63), G (0 to 63), and B (0 to 63) as conversion results. Further, the RGB target correction value setting device 103 outputs the target values TR (0 to 63), TG (0 to 63), and TB (0 to 63) in each gray scale of each color of RGB, that is, the target curve of each color of RGB, in accordance with (a) the target mixture ratios RH, GH, BH, and (b) the target brightness Yo (0 to 63), in step S24. The low gray scale area target value adjustor 104 outputs the target values TTR (0 to 63), TTG (0 to 63), and TTB (0 to 63), that are obtained by correcting the target values at the low gray scale area, in step S25, and each of the foregoing values is one of the target values that have been set by the RGB target correction value setting device 103. The respective sections of FIG. 1 are further detailed as follows.

3-1. Conversion Matrix Generator

The conversion matrix generator 101 of FIG. 4 includes: matrix element generating means 201 to 204; matrix element adjusting means 205; and inverse matrix calculating means 206. Note that, the matrix element generating means 201 to 204 constitute a matrix calculator.

Data of measured values, obtained by using the brightness/chromaticity meter 8 when each highest gray scale of RGB and W is displayed, is inputted to the matrix element generating means 201 to 204. In each of the matrix element generating means 201 to 204, the measured value data of the Yxy color system that is inputted is converted into the XYZ color system data. The conversion is based on the condition under which a relationship between Y, x, y of the Yxy color system and X, Y, Z of the XYZ color system is X:Y:Z=x:y:(1−x−y), Y=Y.

Each of the matrix element generating means 201 to 204 is provided with an adder, a multiplier, a divider, and the like, and the following calculation is performed so as to calculate RX, RZ, GX, GZ, BX, BZ, WX, and WZ.

$$RX=RY\times Rx/Ry$$

$$RZ=RY\times(1-Ry-Rx)/Ry$$

$$GX=GY\times Gx/Gy$$

$$GZ=GY\times(1-Gy-Gx)/Gy$$

$$BX=BY\times Bx/By$$

$$BZ=BY\times(1-By-Bx)/By$$

$$WX=WY\,(63)\times Wx\,(63)/Wy\,(63)$$

$$WZ=WY\,(63)\times(1-Wy\,(63)-Wx\,(63))/Wy\,(63)$$

Note that, the brightness RY, GY, and BY of the Yxy color system are identical to the brightness RY, GY, and BY of the XYZ color system. Further, each group of (a) RX, RY, RZ, (b) GX, GY, GZ, (c) BX, BY, BZ, and (d) WX, WY (63), WZ is a tristimulus value of the XYZ color system in a case where each highest gray scale of RGB and W is displayed.

Here, R, G, and B of the RGB color system and X, Y, and Z of the XYZ color system can be generally expressed as the following Expression (1) by using RX, RZ, GX, GY, BX, and BZ described above. This is based on the following reason: when R=1, G=B=0, a condition under which X=RX, Y=RY, Z=RZ is satisfied, and when G=1, B=R=0, a condition under which X=GX, Y=GY, Z=GZ is satisfied, and when B=1, R=G=0, a condition under which X=BX, Y=BY, Z=BZ is satisfied. Note that, R, G, B, X, Y, and Z in Expression 1 are arbitrary values in each color system.

$$\begin{pmatrix} X \\ Y \\ Z \end{pmatrix} = \begin{pmatrix} RX & GX & BX \\ RY & GY & BY \\ RZ & GZ & BZ \end{pmatrix} \begin{pmatrix} R \\ G \\ B \end{pmatrix} \tag{1}$$

However, there is actually dispersion between the respective liquid crystal panels 7, so that proper conversion sometimes is not performed in accordance with Expression 1. Further, an error etc. of the brightness/chromaticity meter 8 sometimes inhibits the proper conversion. Then, in order to obtain a conversion matrix taking these influences into consideration, Expression 2 is prepared by using factors k, l, and m for correcting the matrix element. The factors k, l, and m of Expression 2 are calculated, so that it is possible to obtain a conversion matrix in terms of the characteristic dispersion between the liquid crystal panels 7, the errors etc. of the brightness/chromaticity meter 8.

$$\begin{pmatrix} X \\ Y \\ Z \end{pmatrix} = \begin{pmatrix} RX/k & GX/l & BX/m \\ RY/k & GY/l & BY/m \\ RZ/k & GZ/l & BZ/m \end{pmatrix} \begin{pmatrix} R \\ G \\ B \end{pmatrix} \tag{2}$$

Note that, the factors are set for each column in Expression 2 for the following reason. For example, a group of RX, RY, RZ in the first column is a tristimulus value obtained upon measuring the R highest gray scale, and the foregoing data are obtained at the same time by a single measurement, so that it is considered that a ratio of RX, RY, and RZ is highly reliable as the characteristic of the liquid crystal panel 7. Meanwhile, for example, a group of RX, GX, and BX in the first column is an X component of the tristimulus value obtained upon measuring the respective RGB highest gray scales, and these values are obtained by measuring the highest gray scales individually. Thus, it is proper that a less reliable ratio of RX, GX, BX is adjusted by setting the factors. Then, the factors are set for each column in Expression 2.

Then, the panel characteristic data measured upon displaying the respective highest gray scales of W is substituted in Expression 2 so as to prepare Expression 3. This Expression 3 is solved, so that the factors k, l, and m are calculated. As a result, it is possible to obtain a matrix shown in Expression 4. Note that, R1=RX/k, G1=GX/1, B1=BX/m, R2=RY/k, G2=GY/1, B2=BY/m, R3=RZ/k, G3=GZ/1, B3=BZ/m.

$$\begin{pmatrix} WX \\ WY \\ WZ \end{pmatrix} = \begin{pmatrix} RX/k & GX/l & BX/m \\ RY/k & GY/l & BY/m \\ RZ/k & GZ/l & BZ/m \end{pmatrix} \begin{pmatrix} 1.0 \\ 1.0 \\ 1.0 \end{pmatrix} \tag{3}$$

$$\begin{pmatrix} R1 & G1 & B1 \\ R2 & G2 & B2 \\ R3 & G3 & B3 \end{pmatrix} \tag{4}$$

Each of the factors k, l, and m is not necessarily 1. This results from the following cause. For example, in the case of displaying the R highest gray scale, and in the case of displaying the W highest gray scale, as to R, the same gray scale value is inputted to the liquid crystal driving circuit 6, but a voltage applied to the liquid crystal panel 7 actually varies in a subtle manner depending on the foregoing cases. The liquid crystal panels 7 are different from each other in the variation, and this may cause the foregoing condition. Further, subtle variation in the brightness and variation in a temperature of the liquid crystal panel 7 that are brought about with passage of time also may cause the foregoing condition.

Note that, the measured value data obtained upon displaying the W highest gray scale is not necessarily the most exact one, but the factors k, l, and m are calculated based on Expression 3 in the correction table factor generator 9 so as to set the target value in each gray scale of the respective RGB colors in accordance with the measured value data of each gray scale (0 to 63 gray scale) of W as described later.

In this manner, calculation for obtaining a matrix of Expression 4 in accordance with RX, RY, RZ, GX, GY, GZ, BX, BY, and BZ described above is performed by the matrix element adjusting means 205. That is, the matrix element adjusting means 205 adjusts a matrix so that the measured value of the W highest gray scale is properly converted.

Further, the inverse matrix calculating means 206 performs inverse transform with respect to the matrix of Expression 4, so that a matrix shown in Expression 5 is obtained. The matrix obtained in this manner becomes a conversion matrix that should be generated by the conversion matrix generator 101.

$$\begin{pmatrix} X1 & Y1 & Z1 \\ X2 & Y2 & Z2 \\ X3 & Y3 & Z3 \end{pmatrix} \tag{5}$$

3-2 Chromaticity Adjustor

The chromaticity adjustor 102 of FIG. 5 includes chromaticity adjusting means 301 to 303.

Elements of the matrix (Expression 5) generated by the conversion matrix generator 101 are inputted to the chromaticity adjusting means 301 to 303. Concretely, X1, Y1, and Z1 are inputted to the chromaticity adjusting means 301, and X2, Y2 and Z2 are inputted to the chromaticity adjusting means 302, and X3, Y3, and Z3 are inputted to the chromaticity adjusting means 303. Further, also the target chromaticity xo and yo is inputted to the chromaticity adjusting means 301 to 303.

Here, when Tx=xo, Ty=yo, Tz=1−Tx−Ty, the chromaticity adjusting means 301 to 303 perform the following calculation so as to calculate RH, GH, and BH respectively.

$$RH = X1 \times Tx + Y1 \times Ty + Z1 \times Tz$$

$$GH = X2 \times Tx + Y2 \times Ty + Z2 \times Tz$$

$$BH = X3 \times Tx + Y3 \times Ty + Z3 \times Tz$$

The calculation indicates the product of the matrix in Expression 5 and (Tx, Ty, Tz), that is, the calculation is to convert (Tx, Ty, Tz) by the matrix in Expression 5. RH, GH, and BH obtained in this manner indicate a mixture ratio of RGB for obtaining a proper white balance.

3-3. RGB Target Correction Value Setting Device

The RGB target correction value setting device 103 of FIG. 6 includes converting means 401 (Yxy→RGB converting means), an RGB target value (highest gray scale) setting device 402, and an RGB target value (64 gray scale) setting device 403.

Data of values measured by the brightness/chromaticity meter 8 upon displaying each gray scale (0 to 63 gray scale) of W is inputted to the converting means 401.

The converting means 401 converts the Yxy color system data WY (0 to 63), Wx (0 to 63), Wy (0 to 63) of each gray scale of W, that are inputted to the converting means 401, into the RGB color system data R (0 to 63), G (0 to 63), and B (0 to 63) for each gray scale.

The conversion is based on Expression 6. Note that, WX (i)=WY (i)×Wx (i)/Wy (i), WZ (i)=WY (i)×(1−Wy (i)−Wx (i))/WY (i).

$$\begin{pmatrix} R(i) \\ G(i) \\ B(i) \end{pmatrix} = \begin{pmatrix} X1 & Y1 & Z1 \\ X2 & Y2 & Z2 \\ X3 & Y3 & Z3 \end{pmatrix} \begin{pmatrix} WX(i) \\ WY(i) \\ WZ(i) \end{pmatrix} \quad (6)$$

Here, Expression 6 is a conversion expression using the conversion matrix (Expression 5) taking influences such as the characteristic dispersion of the liquid crystal panel 7 into consideration. Thus, it is possible to inhibit overflows and conversion errors etc. brought about upon conversion. When the conversion matrix (existing conversion matrix) that has been uniformly set in each liquid crystal panel 7 is used in Expression 6 instead of using the conversion matrix of Expression 5, there occur the overflows and the conversion errors brought about upon conversion. For example, when WX (63), WY (63), and WZ (63) corresponding to the W highest gray scale are converted by using the existing conversion matrix, the characteristic dispersion between the respective liquid crystal panels 7 causes the conversion result not to correspond to (255, 255, 255), and there is a possibility that the conversion result such as (255, 252, 253) and (254, 256, 258) may deviate from the intrinsic highest gray scale value. Particularly in the latter case, the conversion result becomes values that cannot be treated in a data system of 8 bits, so that there occurs the overflows of data.

Further, as shown in FIG. 6, R (63), G (63), and B (63), corresponding to the data when the W highest gray scale is displayed, that is the conversion result brought about by the converting means 401, and RH, GH, and BH indicating the mixture ratio of RGB obtained by the chromaticity adjustor 102 are inputted.

The RGB target value (highest gray scale) setting device 402 determines combination of the respective values of RGB so that it is possible to display the highest brightness in the liquid crystal panel 7 under a condition under which the ratio of RH:GH:BH is satisfied, and outputs the combination. The respective values of RGB (highest gray scale target value) are TRmax, TGmax, and TBmax.

In the RGB target value (highest gray scale) setting device 402, one of R (63), G (63), and B (63) is determined to be a reference value, and the reference value is regarded as the highest gray scale target value, and highest gray scale target values of other two colors are calculated in accordance with (a) the highest gray scale target value and (b) the ratio of RH:GH:BH.

A method for determining one of R (63), G (63), and B (63) to be the reference value is described as follows. It is assumed that R (63) is determined to be the reference value. At this time, the highest gray scale target values of the respective RGB colors are R (63), R (63)×GH/RH, R (63)×BH/RH. Here, when (R (63)×GH/RH)>G (63), or (R (63)×BH/RH)>B (63), the highest gray scale target value of G or B becomes a value more than a displayable value, so that the display cannot actually be performed. That is, when R (63) is determined to be the reference value, it is impossible to display the highest gray scale of B or G. Likewise, assuming a case where G (63) is determined to be the reference and a case where B (63) is determined to be the reference, whether the highest gray scale target value of each case is the value displayable in the liquid crystal panel 7 or not is judged.

The highest gray scale target value, obtained in the case where at least any one of R (63), G (63), and B (63) is determined to be the reference, is supposed to become the value displayable in the liquid crystal panel 7, so that the highest gray scale target values of the respective colors in this case are determined to be actual highest gray scale target values.

Figure 7:
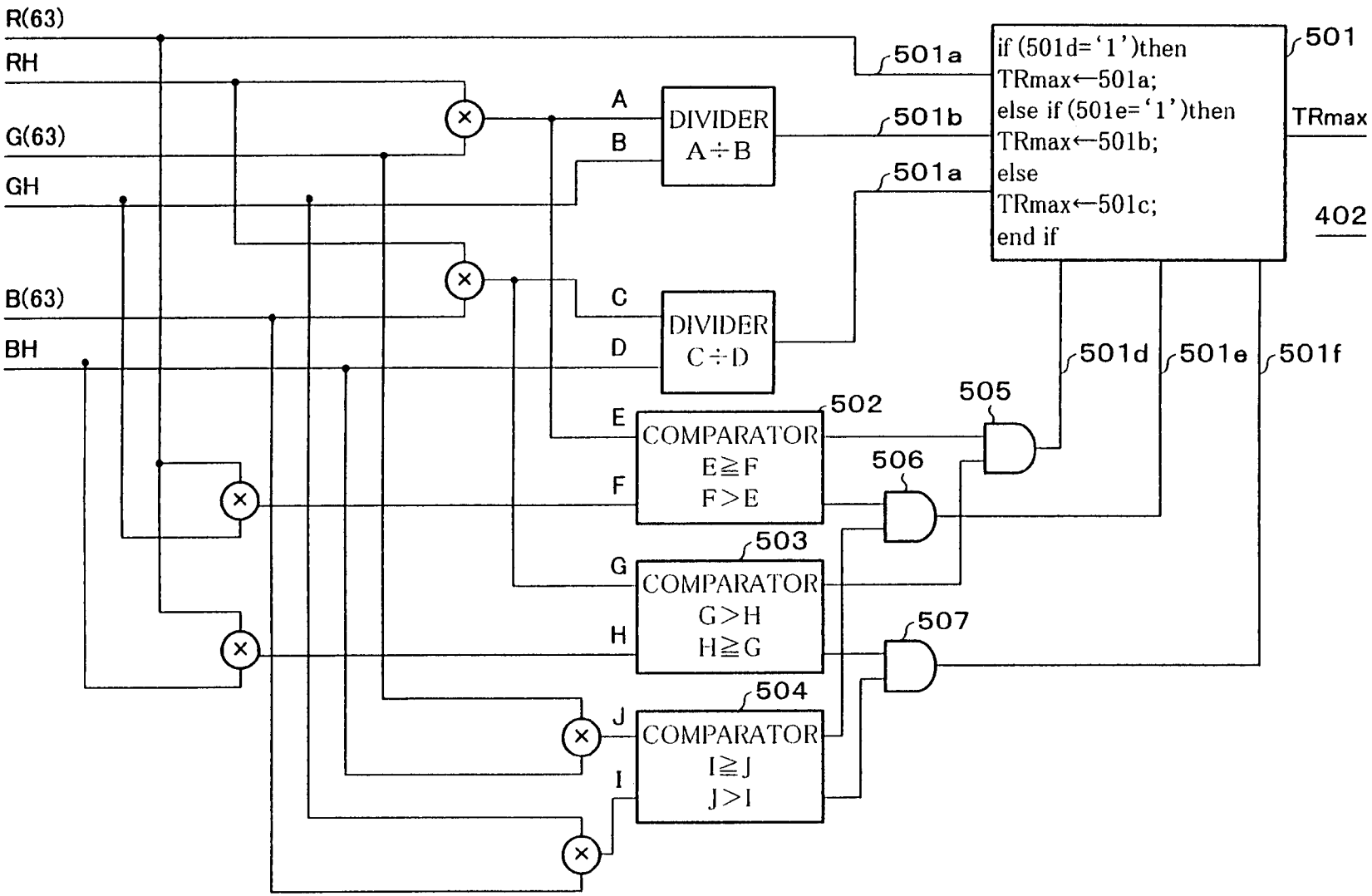
FIG. 7 is a block diagram showing an arrangement of an RGB target value (highest gray scale) setting device included in the RGB target correction value setting device of FIG. 6.

FIG. 7 shows an internal arrangement of the RGB target value (highest gray scale) setting device 402. Note that, FIG. 7 and the following description based on FIG. 7 relate to an arrangement of R. As to arrangements of G and B that are arranged in the same manner as R, drawings and descriptions thereof are omitted (also as to FIG. 8 and FIGS. 11 to 14, descriptions thereof are omitted).

The arrangement shown in FIG. 7 includes an adder, a divider, a comparator, an AND circuit, and a selector 501. The selector 501 includes selected inputs 501*a*, 501*b*, 501*c* and selecting inputs 501*d*, 501*e*, 501*f*.

The selected input 501*a* receives R (63) which is supposed to be the highest gray scale target value in the case where R is determined to be the reference, and the selected input 501*b* receives G (63)×RH/GH which is supposed to be the highest gray scale target value in the case where G is determined to be the reference, and the selected input 501*c* receives B (63)×RH/BH which is supposed to be the highest gray scale target value in the case where B is determined to be the reference.

Each of the selecting inputs 501*d*, 501*e*, and 501*f* receives "1" in a case where the following conditions 1 to 3 are satisfied, and receives "0" in a case where the conditions are not satisfied. The condition 1 is R (63)×GH/RH≦G (63), and R (63)×BH/RH<B (63). The condition 2 is G (63)×BH/GH≦B (63), and G (63)×RH/GH<R (63). The condition 3 is B (63)×RH/BH≦R (63), and B (63)×GH/BH<G (63).

Further, the selector 501 outputs R (63) of the selected input 501*a* as the TRmax in the case where the selecting input 501*d* is "1", and outputs G (63)×RH/GH of the selected input 501*b* as the TRmax in the case where the selecting input 501*e* is "1", and outputs B (63)×RH/BH of the selected input 501*c* as the TRmax in the case where the selecting input 501*f* is "1".

Note that, the comparator 502 outputs "1" to the AND circuit 505 and outputs "0" the AND circuit 506 in the case where RH×G (63)≧GH×R (63). The comparator 502 outputs "0" to the AND circuit 505 and outputs "1" to the AND circuit 506 in the case where GH×R (63)>RH×G (63). The comparator 503 outputs "1" to the AND circuit 505 and outputs "0" to the AND circuit 507 in the case where RH×B (63)>BH×R (63). The comparator 503 outputs "0" to the AND circuit 505 and outputs "1" to the AND circuit 507 in the case where BH×R (63)>RH×B (63). The comparator 504 outputs "1" to the AND circuit 506 and outputs "0" to the AND circuit 507 in the case where GH×B (63)≧BH×G (63).

The comparator 504 outputs "0" to the AND circuit 506 and outputs "1" to the AND circuit 507 in the case where BH×G (63)>GH×B (63).

The AND circuit 505 inputs logical product of the comparator 502's output and the comparator 503's output to the selecting input 501*d*. The AND circuit 506 inputs logical product of the comparator 502's output and the comparator 504's output to the selecting input 501*e*. The AND circuit 507 inputs logical product of the comparator 503's output and the comparator 504's output to the selecting input 501*f*.

Further, as shown in FIG. 6, the RGB target value (64 gray scale) setting device 403 receives (a) TRmax, TGmax, and TBmax that are outputted from the RGB target value (highest gray scale) setting device 402, (b) the target brightness Yo (0 to 63) in each gray scale of W (see FIG. 16), (c) a clock signal CLK, and (d) a reset signal RESET.

The RGB target value (64 gray scale) setting device 403 determines the target values of the respective gray scales (respective gray scale target values) in accordance with (a) the highest gray scale target values TRmax, TGmax, and TBmax that have been set in RGB respectively, and outputs the target value and (b) the target brightness Yo in the respective gray scales. The target values in the respective gray scales of RGB are TR (0 to 63), TG (0 to 63), and TB (0 to 63). Note that, the clock signal CLK and the reset signal RESET are provided from the outside.

Figure 8:
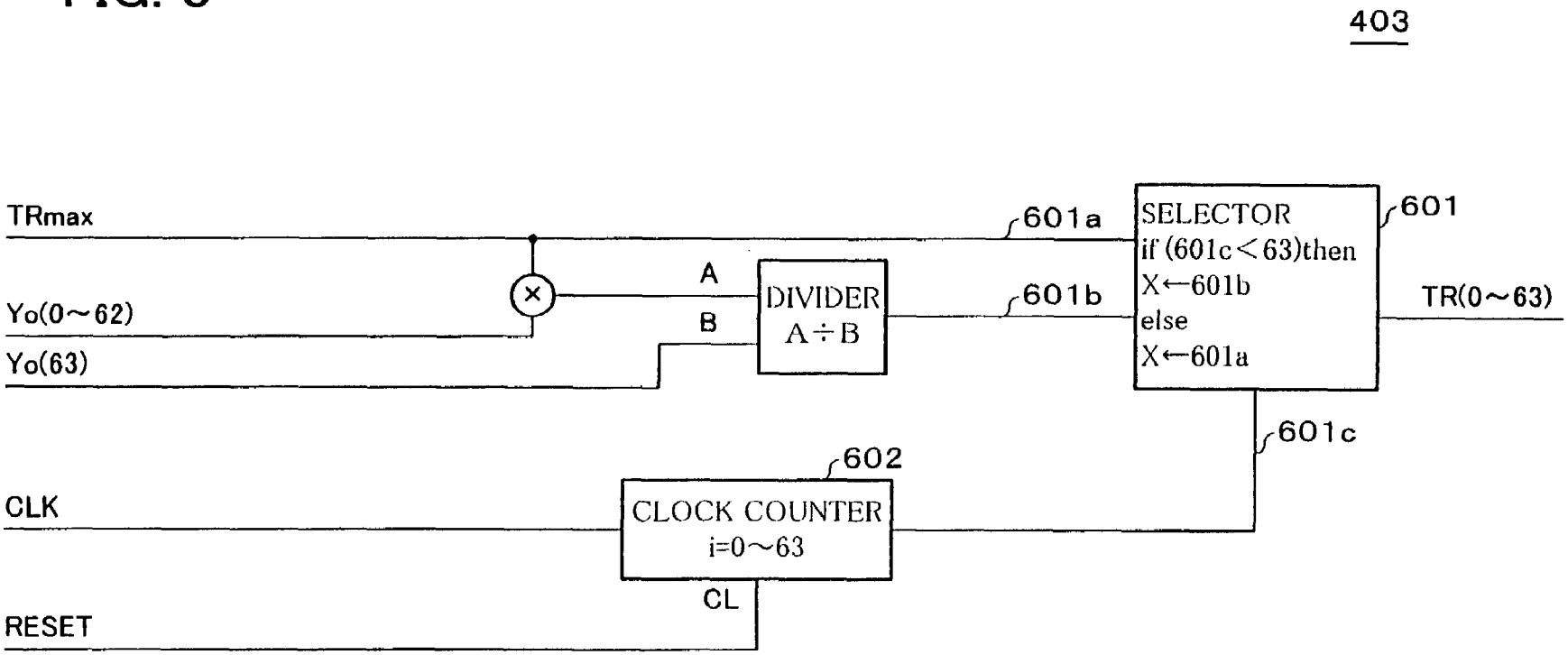
FIG. 8 is a block diagram showing an arrangement of an RGB target value (64 gray scales) setting device included in the RGB target correction value setting device of FIG. 6.

FIG. 8 shows an internal arrangement of the RGB target value (64 gray scale) setting device 403. The arrangement shown in FIG. 8 includes a multiplier, a divider, a selector 601, and a clock counter 602. The selector 601 includes selected inputs 601*a* and 601*b*, and selecting inputs 601*c*.

TRmax and TRmax×Yo (i)/Yo (63) are inputted to the selected inputs 601*a* and 601*b* respectively. Note that, the target brightness Yo (i) sequentially varies from the target brightness Yo (0) of 0 gray scale to the target brightness Yo (63) of 63 gray scale in accordance with a clock pulse of the clock signal CLK.

The selecting input 601*c* receives a count value (i) of the clock pulse of the clock signal CLK that has been counted by the clock counter 602. Note that, the count value of the clock counter 602 is reset to i=0 when it is counted to i=63.

Note that, when the count value i=i1 is inputted to the selecting input 601*c* of the selector 601, timing is adjusted so that TRmax×Yo (i1)/Yo (63) is inputted to the selected input 601*b*.

The selector 601 outputs a value of the selected input 601*b*, that is, TRmax×Yo (i)/Yo (63) in a case where the count value i inputted to the selecting input 601*c* is less than 63, and outputs a value of the selected input 601*a*, that is, TRmax in a case where the count value i inputted to the selecting input 601*c* is 63. Thus, the selector 601 outputs TRmax as TR (63) in the highest gray scale, and outputs TRmax×Yo (i)/Yo (63) as TR (i) in gray scales other than the highest gray scale. Thus, it is possible to obtain the target values TR (0 to 63) in all the gray scales.

Here, a ratio between the target value TR (i) in i gray scale and the target value TR (63) in the highest gray scale is equalized to a ratio between the target brightness Yo (i) in i gray scale and the target brightness Yo (63) in the highest gray scale. Thus, a curve indicated as the target value TR (0 to 63) is such that the highest gray scale is TRmax, and has a leaning similar to that of a curve indicated as the target brightness Yo (0 to 63). That is, the target value TR (0 to 63) is TRmax whose highest gray scale is set in the RGB target value (highest gray scale) setting device 402, and the respective gray scales are set taking the leaning of the target brightness Yo into consideration.

3-4. Low Gray Scale Area Target Value Adjustor

Figure 9:
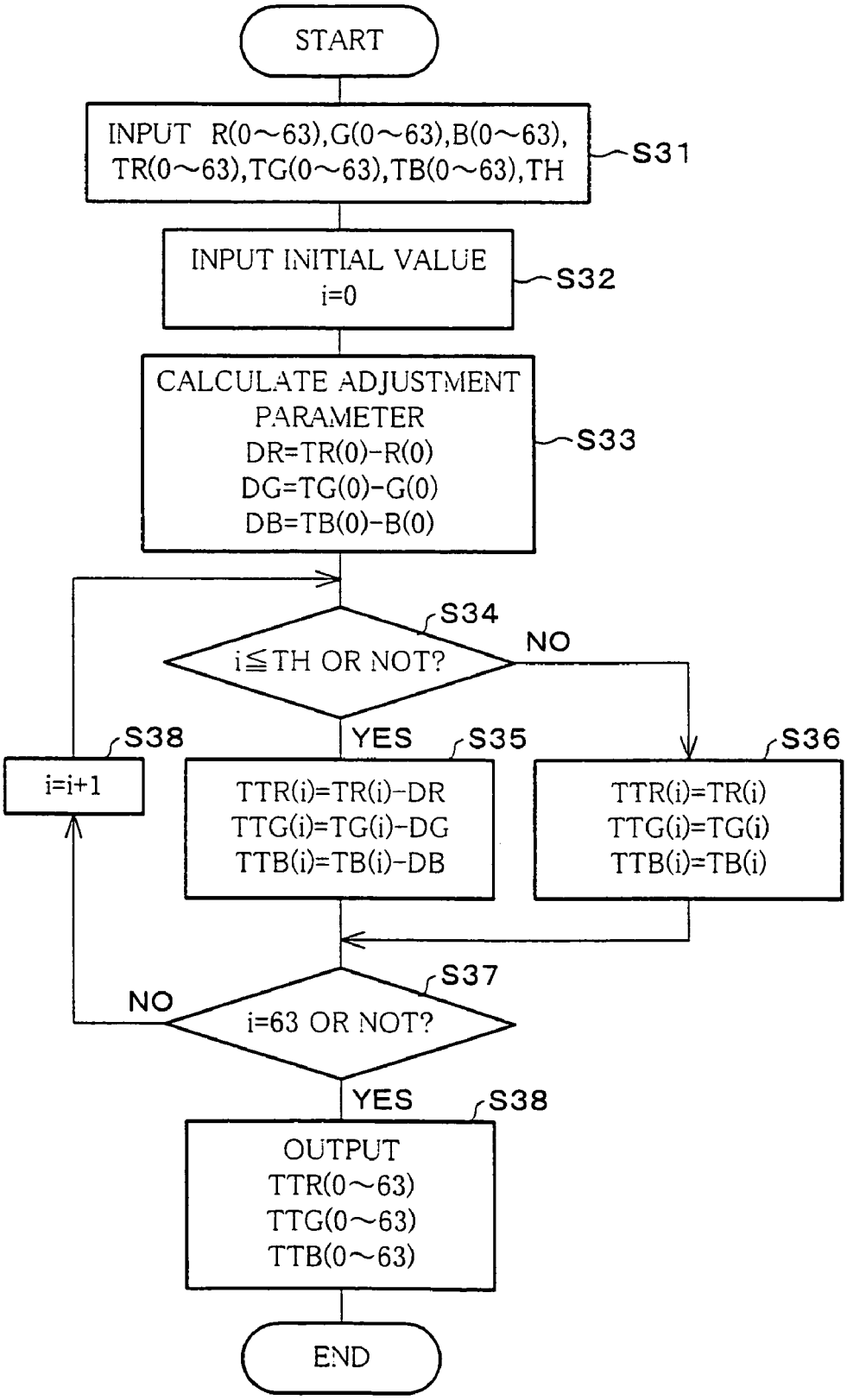
FIG. 9 is a flow chart showing a processing flow in a low gray scale area target value adjustor included in the target value setting section of FIG. 1.
Figure 10:
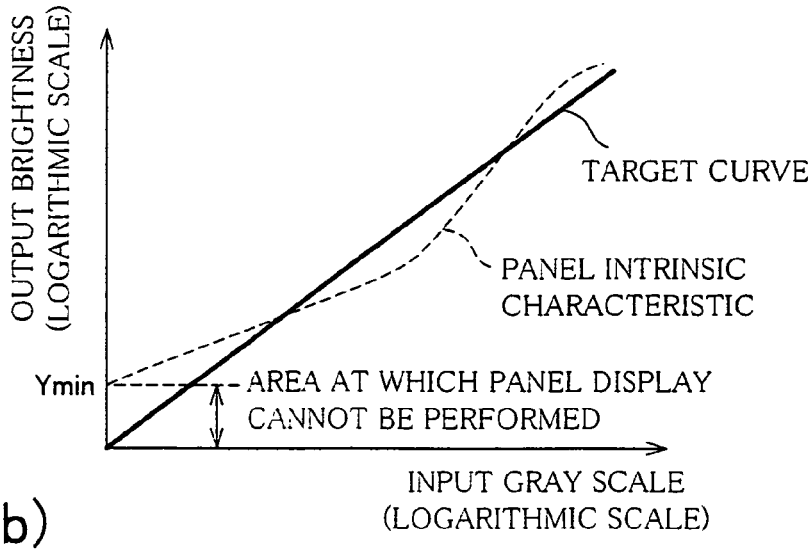
FIG. 10(*a*) is a graph showing a relationship between a panel element characteristic and a target curve, and FIG. 10(*b*) is a graph showing an example of how the target curve is adjusted, and FIG. 10(*c*) is a graph showing another example of how the target curve is adjusted.
Figure 10:
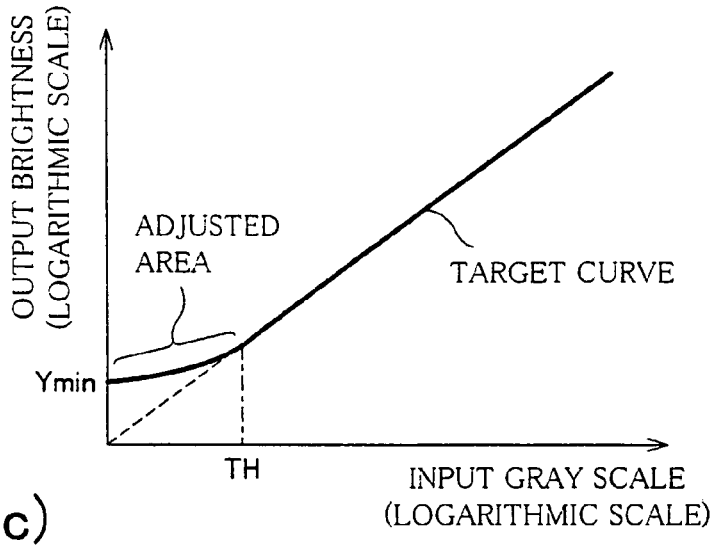
Figure 10:
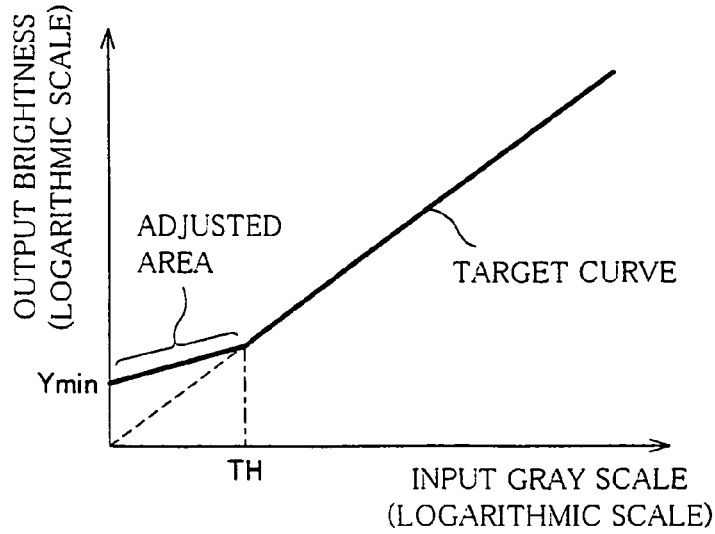

FIG. 9 is a flow chart showing a processing flow in the low gray scale area target value adjustor 104 of FIG. 1. In the low gray scale area target value adjustor 104, as shown in FIG. 10(*a*), in a case where each of curves (target curves) indicated as TR (0 to 63), TG (0 to 63), and TB (0 to 63) that are set in the RGB target correction value setting device 103 requires a value indisplayable at the low gray scale area of the liquid crystal panel 7, the target value is set to be the displayable value, and the target value is adjusted so that the target value at the low gray scale area that has been adjusted smoothly shifts to the target value at a middle/high gray scale area that is not adjusted as shown in FIG. 10(*b*). Note that, when the target value is adjusted without taking the shift from the low gray scale area to the middle/high gray scale area into consideration, the target value at the low gray scale area that has been adjusted suddenly shifts to the target value at a middle/high gray scale area that is not adjusted as shown in FIG. 10(*c*), so that the gray scale variation becomes irregular between the low gray scale area and the middle/high gray scale area. As a result, the display quality deteriorates.

FIGS. 10(*a*) to 10(*c*) are graphs each of which shows a relationship between a gray scale inputted to a display component 13 of FIG. 2 and the brightness (output brightness) in the case of performing display based on the gray scale inputted in the liquid crystal panel 7 of the display component 13. Note that, a horizontal axis (gray scale) and a vertical axis (output brightness) are indicated by logarithmic scales in FIGS. 10(*a*) to 10(*c*). Further, Ymin in FIGS. 10(*a*) to 10(*c*) indicates the lowest output brightness that is displayable in the liquid crystal panel 7. Although the gray scale value I that is actually 8 bit data (see FIG. 16) is inputted to the display component 13, the horizontal axis of each graph is regarded as the gray scale i here for convenience in the description. Each of FIGS. 10(*a*) to 10(*c*) shows the leanings corresponding to RGB and W respectively.

The low gray scale area target value adjustor 104 receives (a) R (0 to 63), G (0 to 63), and B (0 to 63) that are conversion results brought about by the converting means 401 of the RGB target correction value setting device 103, (b) TR (0 to 63), TG (0 to 63), and TB (0 to 63) that have been set by the RGB target value (64 gray scale) setting device 403 of the RGB target correction value setting device 103, and (c) the low gray scale area processing threshold value TH (step S31).

Further, the gray scale i is set to be an initial value 0 (step S32), and adjustment parameters DR, DG, and DB are calculated (step S33). The adjustment parameters DR, DG, and DB are obtained by subtracting R (0), G (0), and B (0) that are values of the panel intrinsic characteristic in the lowest gray scale (corresponding to Ymin in FIG. 10(*a*)) from TR (0), TG (0), and TB (0) that are the target values in the lowest gray scale, as to the target curve set in the RGB target value (64 gray scale) setting device 403 (see FIG. 10(*a*)). Note that, R (0), G (0), and B (0) are outputted from the RGB target correction value setting device 103.

Further, in a case where the gray scale i is not more than the low gray scale area processing threshold value TH (step S34), the adjustment parameters DR, DG, and DB are subtracted from the target values TR (i), TG (i), and TB (i) that have been set by the RGB target value (64 gray scale) setting device 403, so that target adjusted values TTR (i), TTG (i), and TTB (i) are set (step S35). In a case where the gray scale i is more than the low gray scale area processing threshold value TH (step S34), the target values TR (i), TG (i), and TB (i) that have been set by the RGB target value (64 gray scale) setting device 403 are set without change as non-adjusted target values TTR (i), TTG (i), and TTB (i) (step S36). This process is repeated from 0 gray scale to 63 gray scale (steps S34 to S38). Then, the adjusted or non-adjusted target values TTR (0 to 63), TTG (0 to 63), and TTB (0 to 63) that have been obtained are outputted (step S39).

Here, the panel intrinsic characteristic is the target correction value in 0 gray scale, and a value displayable in the liquid crystal panel 7 is set as the target adjusted value. Further, the adjustment parameter is constantly a fixed value, and the adjustment parameter that is the fixed value is subtracted from the target value so as to set the target adjusted value in step S35. Here, the target curve is set in accordance with the target brightness characteristic data Yo indicative of the γ curve shown in FIG. 16, and also the target curve is the γ curve (exponential curve). Thus, the target value exponentially increases as the gray scale increases. Thus, even when an absolute value of the adjustment parameter is constant, a relative value of the adjustment parameter in terms of the target value, that is, a ratio of the adjustment parameter with respect to the target value gradually reduces as the gray scale increases. Then, a gray scale area at which the adjustment parameter exerts so small influence that there occurs no problem with respect to the target value is regarded as the low gray scale area, and the target value is adjusted at the low gray scale area, so that the low gray scale area at which the target value has been adjusted can smoothly shift to the middle/high gray scale area at which the target value is not adjusted.

Note that, although a concrete gray scale to which the low gray scale area processing threshold value TH is set is determined while confirming an actual display, it is preferable to set the low gray scale area processing threshold value to a gray scale at which the target value is not less than 10 times (preferably, 100 times) as high as the value of the adjustment parameter.

FIG. 11 shows an internal arrangement of the low gray scale area target value adjustor 104. The arrangement shown in FIG. 11 includes a subtracter 701, an adder 702, comparators 703 and 704, a selector 705, and a clock counter 706. The selector 705 includes selected inputs 705*a* and 705*b*, and a selecting input 705*c*.

Note that, the subtracter 701, the adder 702, the comparators 703 and 704, and the clock counter 706 constitute adjusted target value selecting means 707, and the selector 705 constitutes adjusted/non-adjusted target value selecting means 708. Further, the subtracter 701 constitutes an adjustment parameter setting device.

The selected input 705*a* receives TR (i), and the selected input 705*b* receives TR (i)−(TR (0)−R (0)). Note that, TR (i) and R (i) subsequently vary from TR (0) and R (0) of 0 gray scale to TR (63) and R (63) of 63 gray scale in accordance with the clock pulse of the clock signal CLK.

In a case where the count value i of the clock pulse of the clock signal CLK that is counted by the clock counter 706 is not more than the low gray scale area processing threshold value TH, 1 is inputted to the selecting inputs 705*c*. In a case where the count value i is more than the low gray scale area processing threshold value TH, 0 is inputted to the selecting input 705*c*. Note that, the count value of the clock counter 706 is reset to i=0 when it is counted to i=63.

Note that, when a value (1 or 0) based on the count value i=i1 is inputted to the selecting input 705*c* of the selector 705, TR (i1) is inputted to the selected input 705*a*, so as to adjust timing so that TR (i1)−(TR (0)−R (0)) is inputted to the selected input 705*b*.

The selector 705 outputs a value of the selected input 705*b*, that is, TR (i)−(TR (0)−R (0)) in a case where 1 is inputted to the selecting input 705*c*, that is, in a case where TR (i) and (TR (0)−R (0)) that are not more than the low gray scale area processing threshold value TH are respectively inputted to the selected input 705*a* and the selected input 705*b*, and outputs a value of the selected input 705*a*, that is, TR (i) in a case where 0 is inputted to the selecting input 705*c*, that is, in a case where TR (i) and (TR (0)−R (0)) that are more than the low gray scale area processing threshold value TH are respectively inputted to the selected input 705*a* and the selected input 705*b*. Thus, the selector 705 outputs the target adjusted value TTR in the gray scale i that is not more than the low gray scale area processing threshold value TH, and outputs the target non-adjusted value TTR (i) in the gray scale i that is more than the low gray scale area processing threshold value TH.

Note that, the comparator 703 compares the low gray scale area processing threshold value TH with the cont value i counted by the clock counter 706, and the comparator 703 inputs 1 to the selecting input 705*c* of the selector 705 in the case where the counter value i is not more than the low gray scale area processing threshold value TH, and inputs 0 to the selecting input 705*c* of the selector 705 in the case where the counter value i is larger than the low gray scale area processing threshold value TH. Further, the comparator 704 outputs 1 only in a case where the count value i of the clock counter 706 is 0, and outputs 0 in other cases. In a case where the comparator outputs 1, that is, in a case where TR (0) and R (0) are inputted to the subtracter 701, the subtracter 701 calculates TR (0)−R (0) so as to output the calculation result. In a case where the comparator 704 outputs 0, an output remains under the same condition as in the case where the comparator 704 has outputted 1. In this manner, the subtracter 701 performs a process for calculating the adjustment parameter (step S33 in FIG. 9).

In the present embodiment, the description on the low gray scale area target value adjustor 104 is such that: the low gray scale area target value adjustor 104 corrects the target curve indicated as TR (0 to 63), TG (0 to 63), and TB (0 to 63) that have been set by the RGB target correction value setting device 103. However, the low gray scale area target value adjustor 104 also can be used to adjust a target curve that has been set otherwise in a device other than the correction table factor generator 9 of the present embodiment. At this time, the target image signal is not limited to color display, but may be applied to monochrome display.

4. Correction Table Factor Generator

Figure 12:
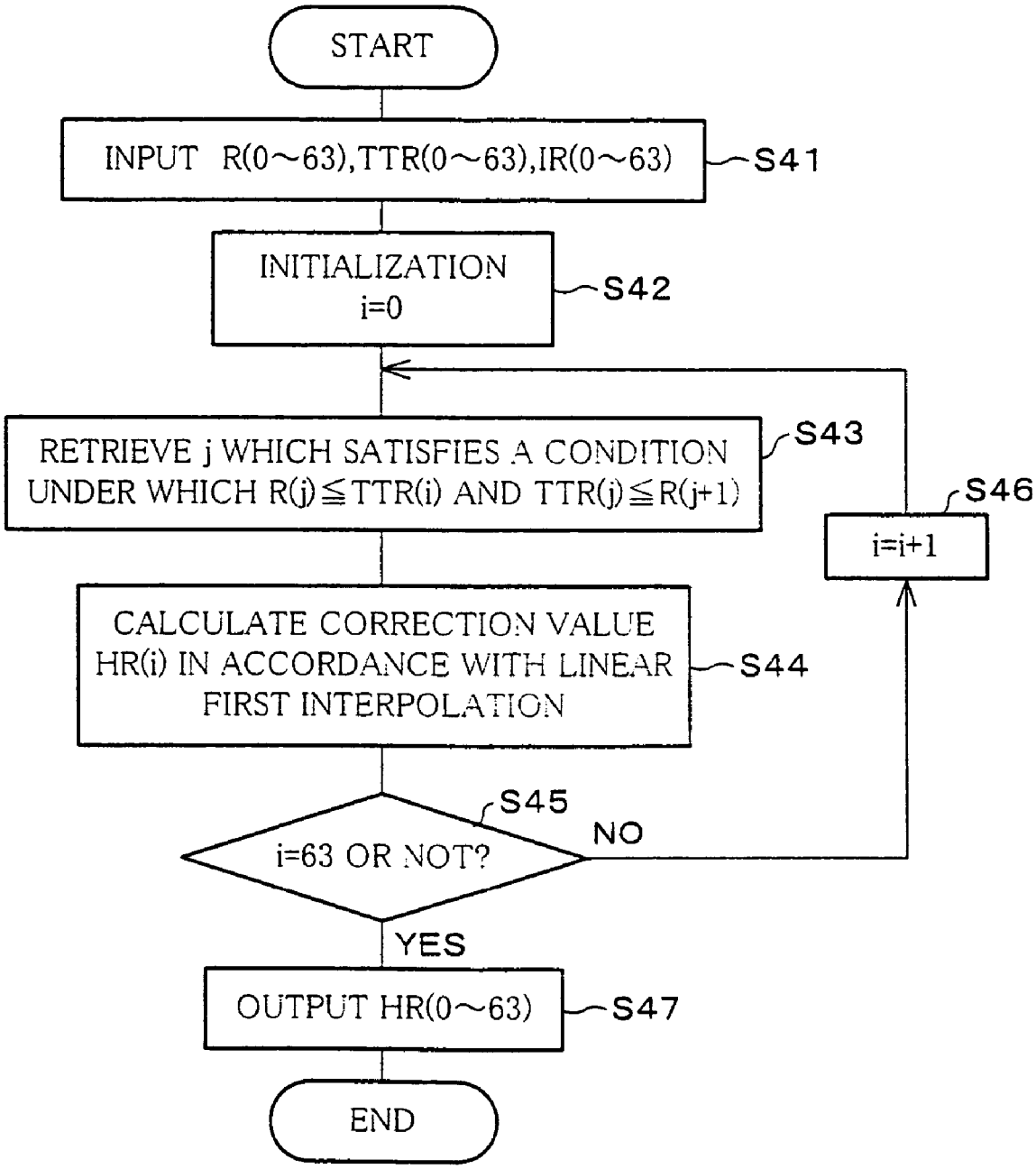
FIG. 12 is a flow chart showing a processing flow in which the correction table factor generating section generates the correction table factor.

In accordance with the target correction value and the non-adjusted target value set in the foregoing manner, a process for causing the correction table factor generator 9*b* to generate the correction table factor is performed as shown in FIG. 12. In this process, in order to display the adjusted or non-adjusted target value TTR (i) in the gray scale i, an adjusted value (adjusted input value) HR (i), a gray scale value that should be inputted to the liquid crystal driving circuit 6, is calculated, so that a contrast table (correction table) of the gray scale i and the adjusted value HR (i) is obtained.

Figure 13:
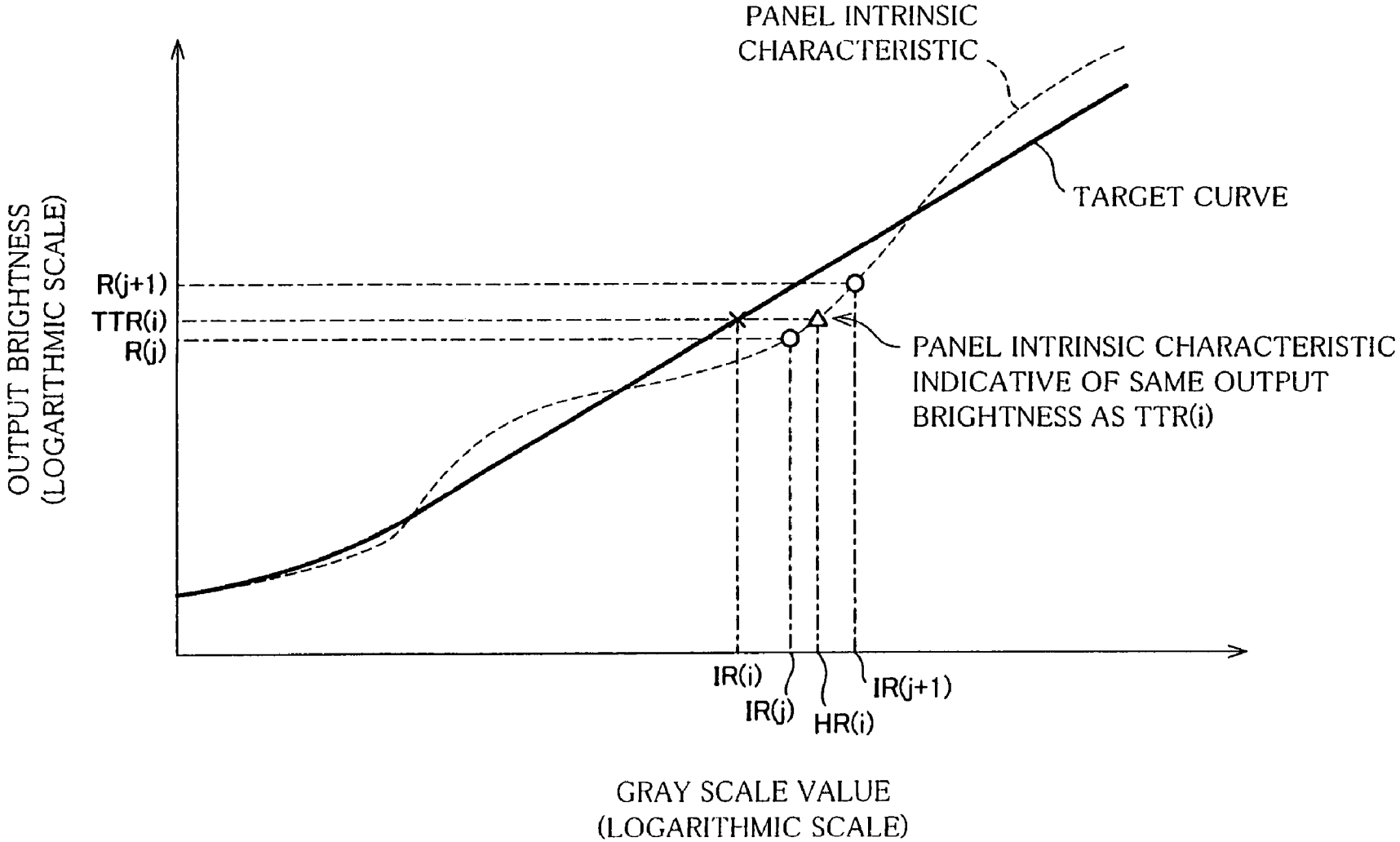
FIG. 13 is a graph for illustrating the content of the process of FIG. 12.

FIG. 12 is a flow chart showing a processing flow in the correction table factor generator 9*b*. Further, FIG. 13 is a graph for illustrating the content of the process of FIG. 12.

The correction table factor generator 9*b* receives (a) R (0 to 63) that is the conversion result brought about by the converting means 401 of the RGB target correction value setting device 103, (b) TTR (0 to 63) outputted from the low gray scale area target value adjustor 104, and a gray scale value IR (i) corresponding to each gray scale 1 (see FIG. 16) (step S41).

Further, the gray scale i is set to be an initial value 0 (step S42), j that satisfies a condition under which $$R(j) \leqq TTR(i), \text{ and } TTR(i) \leqq R(J+1)$$

is retrieved in accordance with R (0 to 63) and TTR (0 to 63) (step S43). Further, in accordance with Expression 7, a linear first interpolation is performed between R (j) and R (j+1) by using R (j), R (j+1), IR (j), and IR (j+1), that correspond to the obtained j, so that the adjusted value HR (j) is calculated (step S44).

$$\frac{TTR(i) - R(j)}{R(j+1) - R(j)} = \frac{HR(i) - IR(j)}{IR(j+1) - IR(j)} \tag{7}$$

This process is repeated from 0 gray scale to 63 gray scale (steps S43 to S46). Then, the obtained adjusted value HR (0 to 63) is outputted to the correction table setting controller 10 (see FIG. 2) (step S47). Note that, since the process of FIG. 12 is a known linear interpolation, a description on a circuit arrangement for performing the process is omitted.

5. Correction Table Setting Controller, RGB Nonlinear Converter

Figure 14:
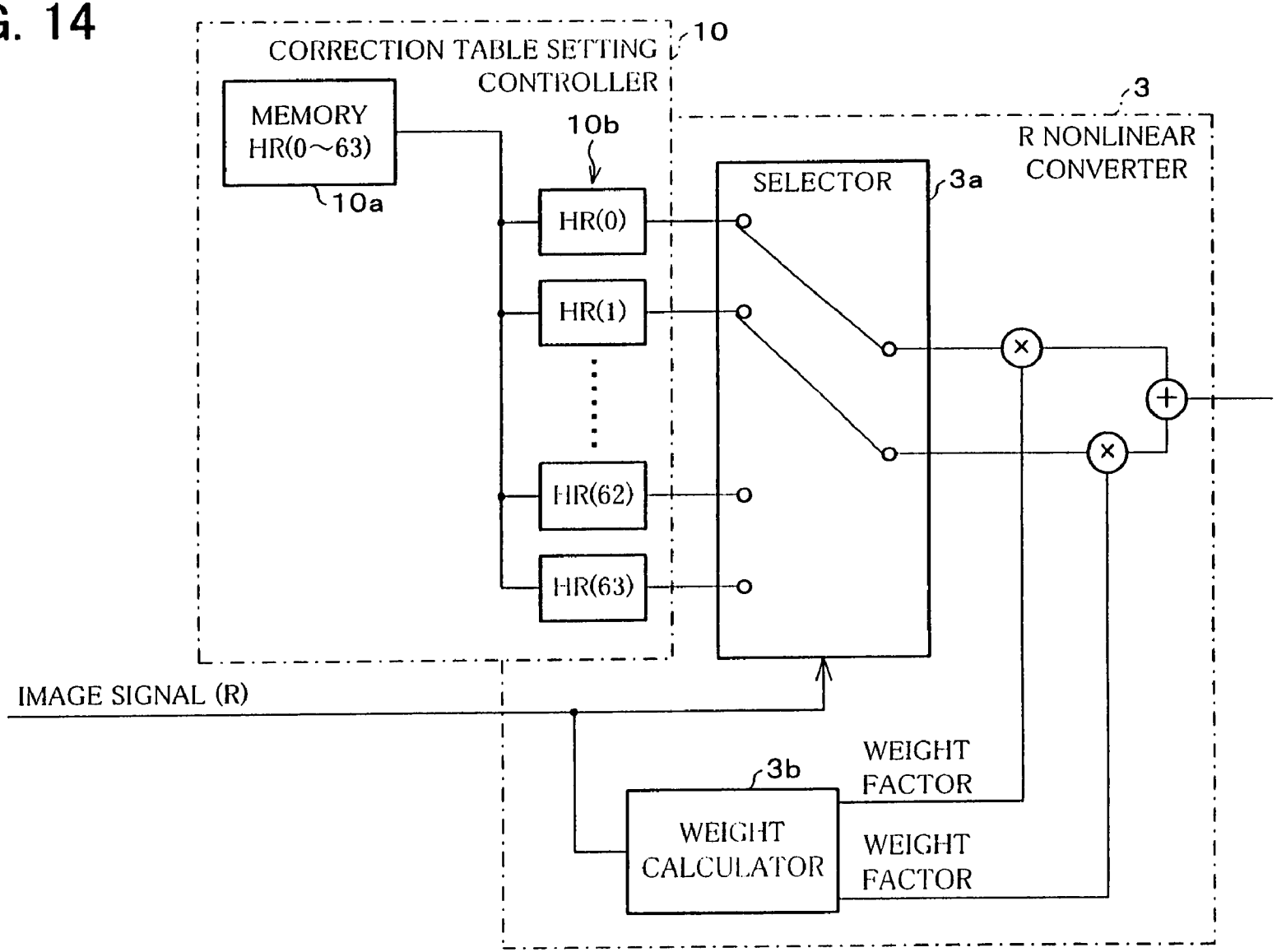
FIG. 14 is a block diagram showing an arrangement of a correction table setting controller and an R nonlinear converter of the liquid crystal display device shown in FIG. 2.

FIG. 14 is a block diagram showing arrangements of the correction table setting controller 10 and the R nonlinear converter 3. The adjusted value HR (0 to 63) outputted from the correction table factor generator 9*b* is stored in a memory 10*a* of the correction table setting controller 10. Further, the adjusted value HR (i), stored in the memory 10*a*, that corresponds to each gray scale i, is set in each of registers 10*b* . . . corresponding to the respective gray scales (i). Thus, setting of the correction table is completed.

In a case where the image signal is actually inputted, the following conversion is performed by using the correction table that has been set by the R nonlinear converter 3. Here, the R nonlinear converter 3 includes a selector 3*a*, a weight calculator 3*b*, a multiplier, and an adder.

The selector 3*a* retrieves the gray scale values IR (j) and IR (j+1), adjacent to each other, that sandwich a gray scale value indicated by the image signal inputted to the R nonlinear converter 3, and the selector 3*a* selects HR (j) and HR (j+1) in accordance with the retrieving result, so as to output HR (j) and HR (j+1). For example, in a case where the gray scale IR is set as shown in FIG. 16, and the gray scale value indicated by the image signal is 97, j=30. Thus, HR (30) and HR (31) are selected, and they are outputted from first and second outputs respectively.

The weight calculator 3*b* calculates first and second weighting factors for performing a linear interpolation with respect to output values of the first and second outputs of the selector 3*a* in accordance with the image signal inputted to the R nonlinear converter 3. In the foregoing example, the first and second weighting factors for being multiplied by the output values of the first and second outputs are calculated respectively in accordance with Expression 8 and Expression 9.

$$1-(97-96)/(100-96)=0.75 \tag{8}$$

$$1-(100-97)/(100-96)=0.25 \tag{9}$$

Further, the multiplier multiplies the first and second weighting factors by the output values of the first and second outputs, and the adder adds the multiplying results to each other. The calculation result is an output to the selector 2 (see FIG. 2). In the foregoing example, the calculation is indicated as Expression 10.

$$HR(30)\times 0.75 + HR(31)\times 0.25 \tag{10}$$

In this manner, the target curve is set in accordance with the panel intrinsic characteristic, and the correction table is generated in accordance with the target curve, so as to perform the γ correction with respect to the panel.

6. Conclusion

As described above, the liquid display device 12 of the present embodiment is provided with the selector 2, the γ correction device 11 (the RGB nonlinear converters 3 to 5, and the correction table setting controller 10), and the display component 13 (the liquid crystal circuit 6 and the liquid crystal panel 7). Moreover, the peripheral devices are the signal generator 1, the brightness/chromaticity meter 8, and the correction table factor generator 9. The compositions, functions and the like of each constituent element are summarized up as below.

(1) The correction table factor generator 9 of the present embodiment (see FIG. 1) includes the target value setting section 9*a* (the conversion matrix generator 101 for generating the conversion matrix for converting from the Yxy color system, to the XYZ color system, then to the RGB color system); the chromaticity adjustor 102; the RGB target correction value setting device 103; and the low gray scale area target value adjustor 104) and the correction table factor generator 9*b*.

(2) The conversion matrix generator 101 (see FIG. 4) includes the matrix element generating means 201, the matrix element adjusting means 205, and the inverse matrix calculating means 206, in order to generate a conversion matrix that is suitable for the panel characteristic of each liquid crystal panel 7 while taking the characteristic dispersion of the liquid crystal panel 7 into consideration. The conversion matrix generator 101, provided with those means, generates the conversion matrix for converting from the Yxy color system to the XYZ color system, then to the RGB color system.

(3) Based on the relationship of X:Y:Z=(x:y:(1−x−y)), the matrix element generating means 201 (see FIG. 4) generates, as matrix elements (matrix factors) of the conversion matrix (see Expression 1) for converting from the RGB color system to the XYZ color system, the values (RX, RY, RZ, GX, GY, GZ, BX, BY, BZ) that are obtained by respectively converting, to the XYZ color system, the measured values (RY, Rx, Ry, GY, Gx, Gy, BY, Bx, By) in the Yxy color system when the highest gray scales of the respective RGB colors are displayed on the liquid crystal panel 7. Moreover, the matrix element generating means 201 also generates the values (WX, WY, WZ) that are obtained by respectively converting the measured values (WY (63), Wx (63), Wy (63)) in the Yxy color system to the XYZ color system when the W highest gray scale is displayed on the liquid crystal panel 7.

(4) For modifying the matrix elements, the matrix element adjusting means 205 (see FIG. 4) (i) attaches the factors (k, l, m) to the matrix elements belonging to the first to third columns of the conversion matrix (a matrix of 3 rows×3 columns) constituted of the matrix elements generated by the matrix element generating means 201, (ii) generates a matrix (Expression 2) so that (α) the conversion results of the conversion performed with respect to values (standardized to 1) for displaying the W highest gray scale of the image signal, for example, of 8 bits in the RGB color system by using the conversion matrix attached with the factors will be equal to the values (WX, WY, WZ) that are obtained by converting, to the XYZ color system, the measured value in the Yxy color system when the W highest gray scale is displayed on the liquid crystal panel 7, and then (iii) solves the simultaneous equation so as to work out the factors attached to the respective columns.

(5) For adjusting the chromaticity of the display of the liquid crystal panel 7, the chromaticity adjustor 102 (see FIG. 5), in order to adjust to the target value the chromaticity of the display of the liquid crystal panel 7, uses the target chromaticity (xo, yo) and the conversion matrix that has been generated by the conversion matrix generator 101, so as to set the target mixture ratio of RGB for the white display by using the chromaticity adjusting means 301 for working out the target mixture ratio (RH, GH, BH) of RGB at the W highest gray scale.

(6) The RGB target correction value setting device 103 (see FIG. 6) is provided with the converting means 401, the RGB target value (highest gray scale) setting device 402, and the RGB target value (64 gray scale) setting device 403, the converting means 401 converting, to the RGB color system, the measured values (WY (0 to 63), Wx (0 to 63) Wy (0 to 63)) in the Yxy color system when each gray scale of W is displayed on the liquid crystal panel 7, by using the conversion matrix generated by the conversion matrix generator 101.

(7) The RGB target value (highest gray scale) setting device 402 (see FIG. 7) determines whether or not the other colors are displayable on the liquid crystal panel 7*b* in case R is regarded as the reference, in case G is regarded as the reference, and in case B is regarded as the reference, based on (α) the RGB target mixture ratio determined by the chromaticity adjustor 102, and (β) the values in the RGB color system, that is, R(63), G(63), and B(63), where the R(63), G(63), and B(63) are obtained by using the converting means 401 converting the measured values (RY, Rx, Ry, GY, Gx, Gy, BY, Bx, By) in the Yxy color system when the W highest gray scale is displayed on the liquid crystal panel 7. Thereby, the RGB target value (highest gray scale) setting device 402 sets the combination of the largest RGB, which satisfy the RGB target mixture ratio and are displayable on the liquid crystal panel 7. Thus set combination is regarded as the highest gray scale target values (TRmax, TGmax, TBmax) of RGB.

(8) The RGB target value (64 gray scale) setting device 403 (see FIG. 8), based on the target brightness Yo (0 to 63) and the highest gray scale target values (TRmax, TGmax, TBmax) of RGB thus set by the RGB target value (highest gray scale) setting device 402, sets each gray scale target value of RGB so that (α) the ratios between the target brightness Yo (63) of the highest gray scale (63 gray scale) and the target brightness Yo (0 to 62) of the respective gray scales are equal to (β) the ratios between the highest gray scale target values of RGB and the respective gray scale target values (TR(0 to 62), TG(0 to 62), TB(0 to 62)) of RGB.

(9) The low gray scale area target value adjustor 104 (see FIG. 11) is provided with the adjusted target value setting means 707 and the adjusted/non-adjusted target value selecting means 708.

(10) The adjusted target value setting means 707 (see FIGS. 9 and 11) subtracts the adjustment parameter from the respective gray scale target values (TR(0 to 63), TG(0 to 63), TB(0 to 63)) to obtain the adjusted target value (TTR(0 to 63), TTG(0 to 63), TTB(0 to 63)), where the adjustment parameter is the difference between (α) the target values (TR(0), TG(0), TB(0)) of the lowest gray scales (0 gray scale) of the respective RGB, and (β) the values (R(0), G(0), B(0)) in the RGB color system, which are obtained by the conversion performed by the converting means 401.

(11) The adjusted/non-adjusted target value selecting means 708 (FIGS. 9 and 11) selects the target values of the respective gray scales when the gray scales are more than the low gray scale area processing threshold value TH, and selects the adjusted target values when the gray scales are not more than the low gray scale area processing threshold value TH, and outputs thus selected values as the adjusted or non-adjusted values (TTR (0 to 63), TTG (0 to 63), TTB (0 to 63)), the adjusted target values (TTR (0 to 63), TTG (0 to 63), TTB (0 to 63)) being set by the adjusted target value setting means 707, and the target values (TR (0 to 63), TG (0 to 63), TB (0 to 63)) of the respective gray scales being set by the RGB target value (64 gray scale) setting device 403.

(12) Based on (α) the adjusted/non-adjusted target values (TTR (0 to 63), TTG (0 to 63), TTB (0 to 63)), which have been set by the low gray scale area target value adjustor 104, and (β) the values (R (0 to 63), G(0 to 63), B(0 to 63)) in the RGB color system, which are obtained by the conversion by the converting means 401, the correction table factor generator 9*b* (see FIG. 2 and 12) calculates out the correction value HR (0 to 63) for outputting the same brightness as the target output brightness for the gray scale value indicated by the image signal, and generates the correction values HR (0 to 63), as the correction table factors, for the 0 to 63 gray scales.

(13) In the method of selecting, from among the gray scale value I(i) corresponding to 256 gray scales displayable on the liquid crystal panel 7, the 0 to 63 gray scales (see FIG. 16), which are to be processed by the RGB target correction value setting device 103 and the elements downstream therefrom, it is so arranged that in accordance with the V-T characteristic (see FIG. 15) of the liquid crystal panel 7, the number of the gray scale values I(i) (sampling point) to be employed as the gray scale i is made large at an area (for example, the A and E areas) at which the variation in the output brightness in association with the change in the gray scale value is small, while the number of the gray scale values I(i) (sampling point) to be employed as the gray scale i is made small at an area (for example, the C area) at which the variation in the output brightness in association with the change in the gray scale value is large.

As described above, the correction table factor generator 9 generates the conversion matrix for converting from the XYZ color system, which is suitable for the liquid crystal panel 7, to the RGB color system, thereby avoiding errors such as overflows and conversion errors which are caused on conversion, and making the following conversion of the instinct characteristic data accurate. Moreover, the correction table factor generator 9 is provided with the low gray scale area target value adjustor 104 as means for adjusting the target value, the means adjusting, at the low gray scale area, the target values (indisplayable target values) that is indisplayable on the liquid crystal panel 7, thereby attaining a smooth transition from the target values at the low gray scale area to the target values in the middle/high gray scale area.

For generating a conversion matrix suitable for the liquid crystal panel 7, the correction table factor generator 9 measures the instinct characteristic of each liquid crystal panel 7, and adjusts the conversion matrix so that the measured value of the W highest gray scale of each individual liquid crystal panel 7 will be always converted to (255, 255, 255), for example, in 8 bit data.

Furthermore, for exactly adjusting the chromaticity, the correction table factor generator 9 converts the target chromaticity (xo, yo) to the RGB color system by using the conversion matrix thus adjusted, thereby obtaining the target mixture ratio of the RGB. Then, the correction table factor generator 9 calculates the RGB target values at the W highest gray scale in accordance with thus obtained target mixture ratio. Then, the correction table factor generator 9 sets the target value of each gray scale so that (α) the ratio between the target values at the highest gray scale and the target value of each gray scale, will be equal to (β) the ratio between the target brightness at the highest gray scale and the target brightness of each gray scale.

Here, in case the target value at the low gray scale area requests a value indisplayable on the liquid crystal panel 7, the correction table factor generator 9 adjusts the target value to be displayable on the liquid crystal panel 7, by subtracting, from the target value, the difference "between the target value at the lowest gray scale and the instinct characteristic" as the adjustment parameter.

If the target value is not smoothly transited from the low gray scale area at which the target value is adjusted, to the middle to high gray scale area at which the target values is not adjusted, a significant change in the color and brightness is caused by a slight difference in the input gray scale on the boundary between the area at which the target value is adjusted and the area at which the target value is not adjusted, when a dim image is displayed. This causes a poor-quality image.

Here, the influence of the adjustment parameter on the target value becomes relatively smaller as the gray scale gets larger, because the adjustment parameter is constant. In other words, the difference on the boundary is negligible for that gray scale among the gray scales transiting from the low gray scale area to the middle/high grays scale area, that is so high that the influence from the adjustment parameter is negligible at the gray scale. This attains the smooth transition from the low gray scale area at which the target value is adjusted to the middle/high gray scale area at which the target value is not adjusted. In short, the smooth transition from the low gray scale area to the middle/high gray scale area is realized by adjusting the target value at the low gray scale area that covers the lowest gray scale to the gray scale at which the adjustment parameter is negligible. With this arrangement, it is possible to make inconspicuous the influence caused by the adjustment of the target value on the boundary between the low gray scale area and the middle/high gray scale area.

With those arrangements, it is possible to display, on the liquid crystal panel 7, a high-quality γ correction image that is specialized (customized) to the characteristic of each liquid crystal panel 7.

The correction characteristic determining device according to the present invention corresponds to the correction table factor generator 9 of the present embodiment. The correction characteristic determining device performs determination of the correction characteristic not only with respect to the liquid crystal display device 12, but also with respect to such display device that corrects an image signal generally constituted of three primary color signals (RGB signals etc.) so as to display a color image in the display means (liquid crystal panel 7, display panel) in accordance with thus corrected image signal. Apart from the liquid crystal panel 7 of the present embodiment, a CRT, a plasma display panel, an electroluminescence panel and the like may be used as the display means.

The correction characteristic determining device according to the present invention determines a correction characteristic in a display device which corrects an image signal constituted of three primary color signals, and displays a color image in display means in accordance with thus corrected image signal, and said correction characteristic determining device includes: data converting means (converting means 401) for converting measured data (panel characteristic data), convertible into a tristimulus value, that indicates a result of measurement performed with respect to an emission condition of display in the display means, into brightness data of three primary colors, by using a conversion matrix; correction characteristic determining means (RGB target value (highest gray scale) setting device 402, RGB target value (64 gray scale) setting device 403, low gray scale area target value adjustor 104) for determining the correction characteristic in accordance with a conversion result obtained by the data converting means; and matrix generating means (conversion matrix generator 101) for generating the conversion matrix. Said matrix generating means includes: matrix element generating means (matrix element generating means 201 to 204) for generating a matrix element of an inverse matrix of the conversion matrix, in accordance with measured data obtained when the display means displays highest gray scales of respective primary colors; matrix element adjusting means (matrix element adjusting means 205) for adjusting a matrix element that has been generated by the matrix element generating means in accordance with measured data obtained when the display means displays a highest gray scale of white; and inverse matrix generating means (inverse matrix calculating means 206) for generating an inverse matrix of a matrix constituted of the matrix element that has been adjusted.

Note that in the present embodiment, the correction characteristic determining means includes the low gray scale area target value adjustor 104. However, the correction characteristic determining means may not include the low gray scale area target value adjustor 104 in case the adjustment of the low gray scale section is unnecessary. The correction characteristic is determined as the relationship between the gray scale value of the image signal and the value (target output brightness) appropriate as actual output brightness of the display means outputted when the gray scale value of the image signal is inputted into the display means. In the present embodiment, the correction characteristic is determined as the relationship between the gray scale i corresponding to the gray scale value I(i) of the image signal, and the target values (target output brightness) TR(0 to 63), TG(0 to 63), and TB(0 to 63).

Moreover, the matrix generating means generates a conversion matrix suitable for the characteristic of the display means so as to enable the data converting means to adequately perform the data conversion. As a result, it is possible to suppress the overflows, the conversion errors and the like on the data conversion, and to enable the correction characteristic determining means to accurately determine the correction characteristic.

It is preferable that the correction characteristic determining device according to the present invention further includes target mixture ratio generating means (chromaticity adjustor 102) for generating a mixture ratio of output brightness (target mixture ratios RH, GH, and BH) of the three primary colors, by converting target chromaticity data (target chromaticity xo, yo), convertible into a tristimulus value, that indicates target chromaticity required in setting display chromaticity in the display means, in accordance with the conversion matrix, wherein the correction characteristic determining means includes highest gray scale determining means (RGB target value (highest gray scale) setting device 402) for determining target output brightness, corresponding to the highest gray scales of the respective primary color signals of the image signal, in accordance with (a) a result obtained by causing the data converting means to convert the measured data obtained when the display means displays the highest gray scale of white and (b) the target mixture ratio.

The target chromaticity is converted by using the conversion matrix suitable for the characteristic of the display means as described above. By doing this, it is possible to prevent the brightness data of the three primary colors from having values deviated from values which the brightness data should have, and to generate an accurate mixture ratio of the output brightness of the three primary colors. In accordance with the mixture ratio, the highest gray scale determining means determines the target output brightness corresponding to the highest gray scale value of each primary color of the image signal, thereby setting the highest gray scale to have the accurate mixture ratio.

It is preferable that the highest gray scale determining means is such that, in accordance with (a) a ratio of brightness data of the respective primary colors that has been obtained by causing the data converting means to convert the measured data obtained when the display means displays the highest gray scale of white, and (b) the target mixture ratio, the highest gray scale determining means regards the brightness data of one primary color signal, being shortest, as the target output brightness corresponding to the highest gray scale value of the primary color signal, and regards the target output brightness as a reference value, so as to determine other target output brightness corresponding to highest gray scale values of other primary color signals in accordance with the target mixture ratio.

In the above arrangement, the primary colors other than one of the primary color that is regarded as the reference, have target output brightness not more than the brightness data of the conversion result. Therefore, with the above arrangement, no such drawback will be caused for any of the primary colors, that brightness actually indisplayable on the display means is determined as the target output brightness corresponding to the highest grays scale value. Therefore, it is possible to avoid that the highest gray scale of white is displayed with deviated target mixture ratio.

It is preferable that the correction characteristic determining means includes intermediate gray scale determining means (RGB target value (64 gray scale) setting device 403) that determines the target output brightness corresponding to a plurality of intermediate gray scale values of the respective primary color signals in accordance with (a) the target output brightness (target brightness Yo (63)) corresponding to the highest gray scale values of the respective primary color signals that have been determined by the highest gray scale determining means, and (b) a ratio of the target output brightness (target brightness Yo (63)) corresponding to the highest gray scale value that has been set with respect to the display means and the target output brightness (target brightness Yo (0 to 62)) respectively corresponding to the intermediate gray scale values.

With the above arrangement, it is possible to determine the target output brightness corresponding to the plurality of intermediate gray scale values of the respective primary color signals corresponding to the target brightness Yo (0 to 63).

It is preferable that, in the display means, a relationship between gray scale values of the respective primary color signals and output brightness is such that density of gray scale values employed as the intermediate gray scale values is made higher at a gray scale value area (A and E area of FIG. 15), at which variation of the output brightness is relatively small with respect to variation of the gray scale value, than at a gray scale value area (C area of FIG. 15), at which the variation of the output brightness is relatively large with respect to the variation of the gray scale value.

With the above arrangement, it is possible to carry out appropriate interpolation with a limited number of sampling points, for calculating out a gray scale value other than the gray scale values (sampling points) employed as the plurality of the intermediate gray scale values by the interpolation or the like.

It is preferable that the correction characteristic determining means includes gray scale adjusting means (low gray scale area target value adjustor 104) for adjusting the target output brightness, corresponding to the intermediate gray scale values of the respective primary color signals, that has been determined by the intermediate gray scale determining means, in accordance with the result (R (0), G (0), B(0)) obtained by causing the data converting means to convert the measured data (WY (0), Wx (0), Wy (0)) obtained when the display means displays the lowest gray scale of white (0 gray scale).

With the above arrangement, in which the target output brightness corresponding to the intermediate gray scale value is adjusted in consideration of the characteristic of the display (black state) of the lowest gray scale of white on the display means, it is possible to avoid that target output brightness actually indisplayable on the display means is set.

It is preferable that, as to each of the primary color signals, the gray scale adjusting means subtracts the result, obtained by causing the data converting means to convert the measured data obtained when the display means displays the lowest gray scale of white, from the target output brightness corresponding to the lowest gray scale of white that has been determined by the intermediate gray scale determining means, so as to obtain an adjustment parameter DR, DG, DB of the primary color signal, and the gray scale adjusting means subtracts the adjustment parameter of the primary color signal from at least indisplayable target brightness so as to perform adjustment, and the indisplayable target brightness is part of the target brightness corresponding to the intermediate gray scales determined by the intermediate gray scale determining means.

With the above arrangement, it is possible to adjust the target output brightness corresponding to the lowest gray scale of white, to the lowest displayable output brightness (corresponding to Ymin of FIG. 10) that is the lowest output brightness actually displayable on the displaying means. Thus, it is possible to effectively utilize the low gray scale area that is actually displayable on the display means, thereby avoiding that actually indisplayable target output brightness is set.

It is preferable that the gray scale adjusting means performs the adjustment with respect to part of the intermediate gray scale values, and the part is not more than a threshold value (low gray scale area processing threshold value TH) which is set as an upper limit of the gray scale that should be adjusted.

With the above arrangement, the threshold is appropriately set so as to smoothly transit from the area at which the target output brightness is adjusted, to the area at which the target output brightness is not adjusted. Thus, it is possible to prevent the color and the brightness from being significantly varied due to a slight differences in the gray scales when a dim image is displayed on the display means.

It is preferable that the correction characteristic determining device according to the present invention further includes gray scale value converting means (correction table factor generator 9*b*) for determining corrected gray scale values, corresponding to the highest gray scale values of the respective primary color signals and the plurality of intermediate gray scale values of the respective primary color signals, in accordance with (a) the target output brightness and (b) the result obtained by causing the data converting means to convert the measured data obtained when the display means displays the highest gray scale of white and the plurality of intermediate gray scale values. In the present embodiment, the corrected gray scale (correction value HR (i)), corresponding to the gray scale i that has been made to correspond to the gray scale value I (i) of the image signal, is determined.

With the above arrangement, it is possible to determine the corresponding relationship between the gray scale of the image signal and the thus corrected gray scale value corresponding to that grays scale. By offering the corresponding relationship to the display apparatus, it is possible to enable the display means to perform the correction with ease.

Note that the gray scale adjusting means may be used in other correction characteristic determining device. In other words, the gray scale adjusting means may be used in a general correction characteristic determining device for performing the correction of the image signal, and determining the correction characteristic in the display apparatus for displaying the image on the display means in accordance with the thus corrected signal.

In this case, the gray scale adjusting means has a function of setting the adjustment parameter by subtracting ($\alpha$) actual values of the brightness (R(0), G(0), B(0) in the present embodiment) for the display of the lowest gray scale on the display means, from ($\beta$) the lowest target output brightness (TR(0), TG(0), TB(0) in the present embodiment) on the target curve, the lowest target output brightness corresponding to the lowest gray scale value (0 gray scale in the present embodiment) of the image signal. Further, the gray scale adjusting means also has a function of adjusting the target curve by subtracting the adjustment parameter from at least the target output brightness less than the lowest target output brightness among the target output brightness on the target curve.

The target curve is set by the target curve setting means (the RGB target correction value setting device 103 in the present embodiment), so as to illustrate the corresponding relationship between the non-corrected gray scale value of the image signal, and the target output brightness to be displayed on the display means for the gray scale.

The correction characteristic determining device is only required to be so arranged as to include the gray scale value converting means (the correction table factor generator 9*b* in the present embodiment), wherein the gray scale value converting means determines, based on the target curve adjusted by the gray scale adjusting means, the relationship between the non-corrected gray scale value of the image signal, and that corrected gray scale value thereof.

7. Supplement

The liquid crystal display apparatus 12 shown in FIG. 12 is provided with the selector 2 for outputting, to the liquid crystal driving circuit 6, selectively the signal outputted from the signal generator 1, or the signal outputted from the $\gamma$ correction device 11.

Figure 17:
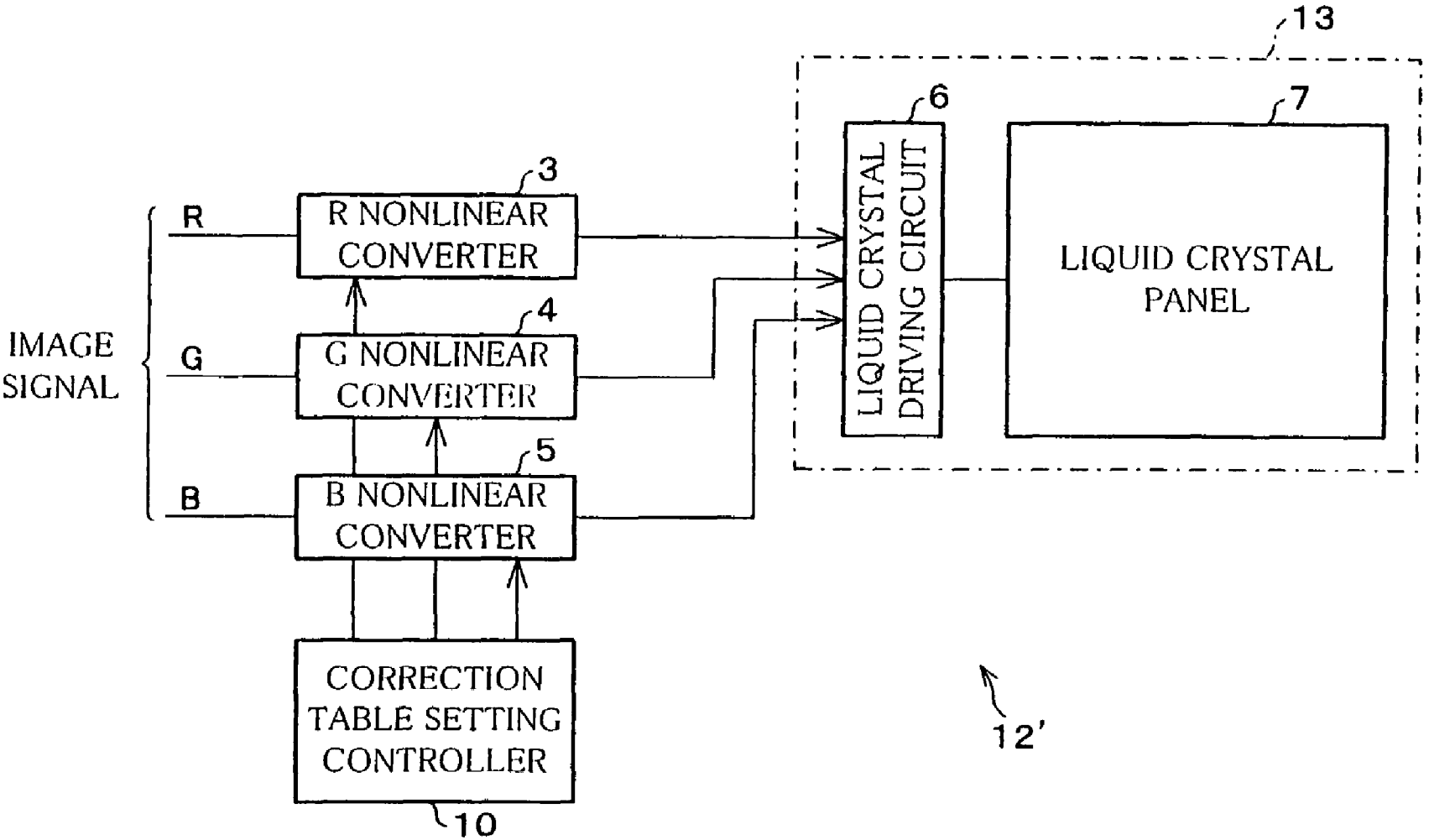
FIG. 17 is a block diagram showing an arrangement of a liquid crystal display device according to one embodiment of the present invention.

A display device of the present invention may be so arranged as to be provided with no selector 2, similarly to a liquid crystal display device 12' shown in FIG. 17. The liquid crystal display device 12' may be so arranged that, for measuring the instinct characteristic of a liquid crystal panel 7, the RGB nonlinear converters 3 to 5 receive, as image signals, each signal of each RGB highest gray scale, white (W) highest gray scale, and other W gray scales (62 to 0), which are outputted from the signal generator 1 in the arrangement shown in FIG. 2, but supply the signals to the liquid crystal driving circuit 6, without converting the signal.

Thus, the display device of the present invention corrects an image signal constituted of three primary color signals (RGB signals etc.), and displays a color image in display means (liquid crystal panel 7) in accordance with thus corrected image signal, and said display device includes: storage means (correction table setting controller 10) for storing corrected gray scale values (correction value HR (i)) determined by the correction characteristic determining device (correction table factor generator 9) described above; and signal converting means (RGB nonlinear converters 3 to 5) for converting the image signal into the corrected image signal in accordance with the corrected gray scale values that have been stored in the storage means.

The display device realizes a high-quality display, because the display device is so arranged that the correction characteristic determining device appropriately determines the correction characteristic.

Moreover, the display is so arranged that the signal converting means interpolates the corrected gray scale value stored in the storage means in response to the image signal, thereby generating the corrected signal.

With this arrangement, it is possible to calculate out the gray scale value other than the gray scale value I(i) employed as the gray scale i in FIG. 16. Thus, it becomes possible to maintain high-quality display with a fewer number of the gray scale values I(i) employed as the gray scale i. Therefore, it becomes possible to reduce the capacity of the storage means, that is, the capacity of the memory 10*a* and the register 10*b*.

In addition, in the liquid crystal display device 12 and the liquid crystal display device 12', it is possible to suppress the unevenness of the actual output brightness on the liquid crystal panel 7, for example, within +/−5% (the area sandwiched between the broken lines in FIG. 18) with respect to the target brightness characteristic data Yo, when the gray scale value is more than the low gray scale area processing threshold value TH. As described above, in the display device of the present invention, when the intermediate gray scale value is inputted as the image signal, if the intermediate gray scale value is equal to or higher than a certain value, it is possible to suppress, within +/−5% the unevenness of the actual output brightness on the liquid crystal panel 7 with respect to the target brightness characteristic data Yo.

Figure 18:
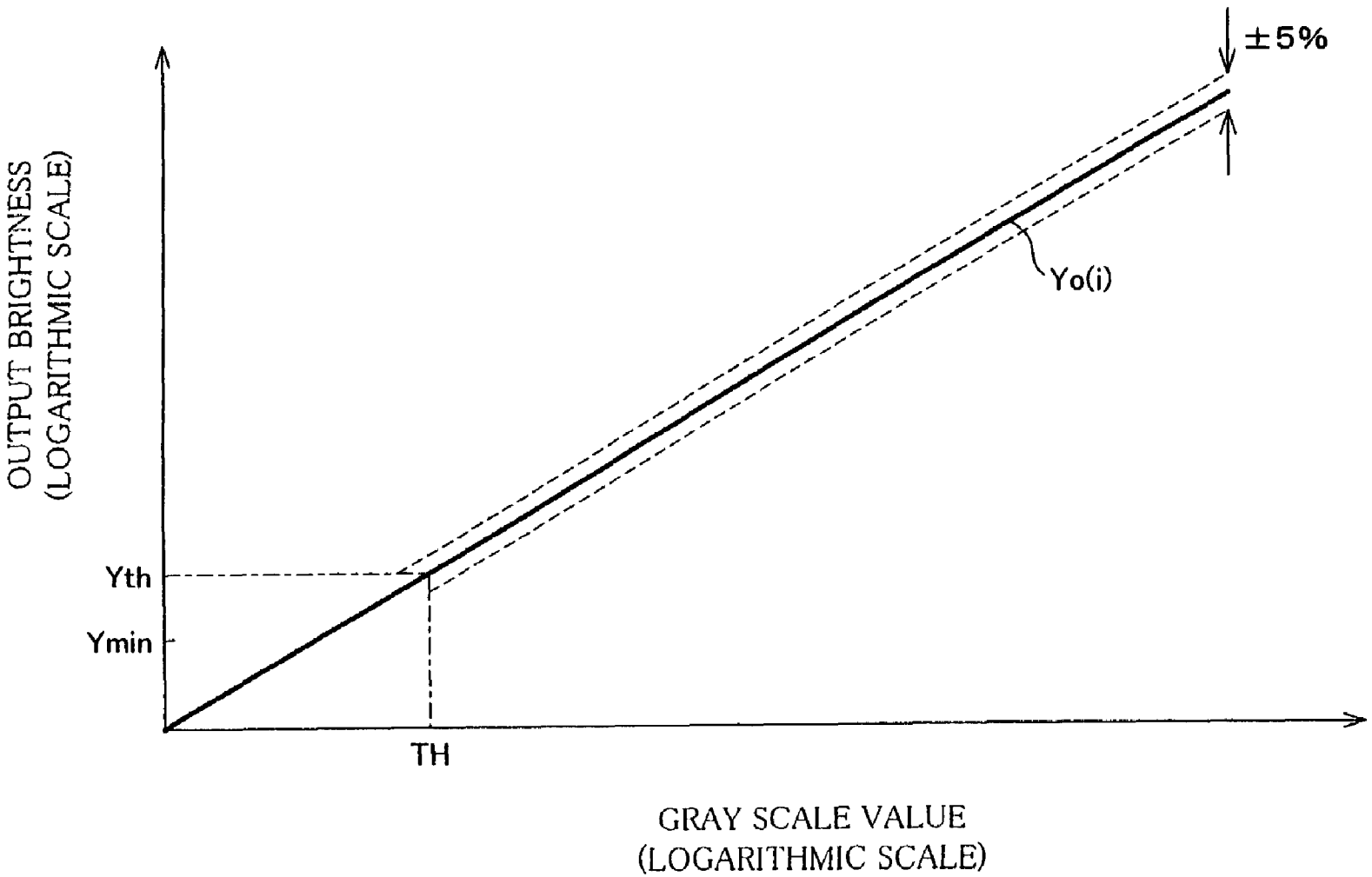
FIG. 18 is a graph showing a distribution range of actual output brightness in the liquid crystal display device of FIG. 17.

Moreover, it is preferable that the low gray scale area processing threshold value TH is set to a gray scale at which the brightness equal to or higher than 10 times (more preferably 100 times) of the output brightness of the liquid crystal panel 7 outputted when the signal of the lowest gray scale is inputted in the liquid crystal display apparatus 12. In short, it is preferable that $Yth \geqq 10 \times Ymin$ (more preferably, $Yth \geqq 100 \times Ymin$) in FIG. 18 is satisfied.

As described above, the correction characteristic determining device according to the present invention determines a correction characteristic of a display device which corrects an image signal constituted of three primary color signals, and displays a color image in display means in accordance with thus corrected image signal, and in order to solve the foregoing problems, said correction characteristic determining device includes: data converting means for converting measured data, convertible into a tristimulus value, that indicates a result of measurement performed with respect to an emission condition of display in the display means, into brightness data of three primary colors, by using a conversion matrix; correction characteristic determining means for determining the correction characteristic in accordance with a conversion result obtained by the data converting means; and matrix generating means for generating the conversion matrix, wherein said matrix generating means includes: matrix element generating means for generating a matrix element of an inverse matrix of the conversion matrix, in accordance with measured data obtained when the display means displays highest gray scales of respective primary colors; matrix element adjusting means for adjusting a matrix element that has been generated by the matrix element generating means in accordance with measured data obtained when the display means displays a highest gray scale of white; and inverse matrix generating means for generating an inverse matrix of a matrix constituted of the matrix element that has been adjusted.

With the above arrangement, in which the measured data is converted into the brightness data of three primary colors, it is possible to understand, as the brightness data of the three primary colors, the characteristic of the display means of the display device, thereby allowing the correction characteristic determining means to determine desired correction characteristic based on the brightness data of the three primary colors.

Note that the measured data is data in which the result of the measurement performed with respect to the emission condition of the display in the display means is indicated in the value convertible into the tristimulus value. For example, the measured data is obtained from measuring means such as brightness/chromaticity meter, and the like. The "value convertible into the tristimulus value" may be a tristimulus value, such as X, Y, Z in the XYZ color system, or a value correlated to the tristimulus value, for example, Y, x, y in the Yxy color system.

Moreover, the correction characteristic is determined as the relationship between the gray scale value of the image signal, and the value (target output brightness) appropriate as the actual output brightness in the display means outputted when the gray scale value is inputted into the display means.

Here, the matrix generating means generates the conversion matrix to be utilized for the data conversion performed by the data converting means. The matrix generating means generates the conversion matrix by using the matrix element generating means, the matrix element adjusting means and the inverse matrix generating means.

The matrix element generating means is capable of generating the matrix element of the inverse matrix of the conversion matrix, because Expression 1 in the embodiment holds by using the measured data obtained when the display means displays the highest gray scale of each primary color.

The matrix element adjusting means generates Expression 2 of the embodiment by using the matrix element generated by the matrix element generating means, and substitutes into Expression 2 the measured data obtained when the display means displays the highest gray scale of white, thereby obtaining Expression 3. By solving Expression 3, the matrix element adjusting means is capable of adjusting the matrix element suitable for the characteristic of the display means.

The inverse matrix generating means is capable of generating the inverse matrix by generating the inverse matrix of the matrix constituted of the matrix element thus adjusted by the matrix element adjusting means.

In this way, the conversion matrix suitable for the characteristic of the display means is generated by the matrix generating means. This enables the data converting means to adequately perform data conversion. As a result, it is possible to avoid errors such as overflows and conversion errors which are caused on conversion, and enable the correction characteristic determining means to accurately determine the correction characteristic.

It is preferable that the correction characteristic determining device according to the present invention, described above, further includes target mixture ratio generating means for generating a mixture ratio of output brightness of the three primary colors, by converting target chromaticity data, convertible into a tristimulus value, that indicates target chromaticity required in setting display chromaticity in the display means, in accordance with the conversion matrix, wherein the correction characteristic determining means includes highest gray scale determining means for determining target output brightness, corresponding to the highest gray scales of the respective primary color signals of the image signal, in accordance with (a) a result obtained by causing the data converting means to convert the measured data obtained when the display means displays the highest gray scale of white and (b) the target mixture ratio.

In the above arrangement, the target mixture ratio generating means converts the target chromaticity data into the brightness data of the three primary colors by using the conversion matrix, thereby generating the mixture ratio of the output brightness of the three primary colors. The target chromaticity data is supplied to the present correction characteristic determining device, for example externally. As described above, the target chromaticity data is converted by using the conversion matrix suitable for the characteristic of the display means. Thereby, it is possible to prevent the brightness data of the three primary colors from having values deviated from values which the brightness data should have, and to generate an accurate mixture ratio of the output brightness of the three primary colors. In accordance with the mixture ratio, the highest gray scale determining means determines the target output brightness corresponding to the highest gray scale value of each primary colors of the image signal, thereby setting the highest gray scale to have the accurate mixture ratio.

It is preferable that the correction characteristic determining device according to the present invention, having the highest gray scale determining means, is arranged so that the highest gray scale determining means is such that, in accordance with (a) a ratio of brightness data of the respective primary colors that has been obtained by causing the data converting means to convert the measured data obtained when the display means displays the highest gray scale of white, and (b) the target mixture ratio, the highest gray scale determining means regards the brightness data of one primary color signal, being shortest, as the target output brightness corresponding to the highest gray scale value of the primary color signal, and regards the target output brightness as a reference value, so as to determine other target output brightness corresponding to highest gray scale values of other primary color signals in accordance with the target mixture ratio.

In the above arrangement, the target output brightness of the primary colors other than the one of the primary colors that is regarded as the reference, have target output brightness less than the brightness data of the conversion result. Therefore, with the above arrangement, no such drawback will be caused for any of the primary colors that brightness that is actually indisplayable on the display means is determined as the target output brightness corresponding to the highest grays scale value. Therefore, it is possible to avoid that the highest gray scale of white is displayed with deviated target mixture ratio.

It is preferable that the correction characteristic determining device according to the present invention, having the highest gray scale determining means, is arranged so that the correction characteristic determining means includes intermediate gray scale determining means that determines the target output brightness corresponding to a plurality of intermediate gray scale values of the respective primary color signals in accordance with (a) the target output brightness corresponding to the highest gray scale values of the respective primary color signals that have been determined by the highest gray scale determining means, and (b) a ratio of the target output brightness corresponding to the highest gray scale value that has been set in the display means and the target output brightness respectively corresponding to the intermediate gray scale values.

In the above arrangement, the target output brightness corresponding to the highest gray scale values of each primary signals determined by the highest gray scale determining means is regarded as the reference. Further in the above arrangement, the target output brightness corresponding to the plurality of intermediate gray scale values of each primary signal is determined in accordance with the ratio between the target output brightness corresponding to the highest gray scale value that has been set with respect to the display means and the target output brightness respectively corresponding to the plurality of intermediate gray scale values. With the above arrangement, it is therefore possible to set the target output brightness corresponding to the ratio that has been set with respect to the display means. In addition, the ratio that has been set with respect to the display means is supplied to the present correction characteristic determining device.

It is preferable that the correction characteristic determining device according to the present invention, having the intermediate gray scale determining means, is arranged so that, in the display means, a relationship between gray scale values of the respective primary color signals and output brightness is such that density of gray scale values employed as the intermediate gray scale values is made higher at a gray scale value area, at which variation of the output brightness is relatively small with respect to variation of the gray scale value, than at a gray scale value area, at which the variation of the output brightness is relatively large with respect to the variation of the gray scale value.

With the above arrangement, it is possible to perform appropriate interpolation with a limited number of sampling points, in case interpolation and the like is performed for calculating out the gray scale values other than the gray scale values (sampling points) employed as the plurality of the intermediate gray scale values.

It is preferable that the correction characteristic determining device according to the present invention, having the intermediate gray scale determining means, is arranged so that the correction characteristic determining means includes gray scale adjusting means for adjusting the target output brightness, corresponding to the intermediate gray scale values of the respective primary color signals, that has been determined by the intermediate gray scale determining means, in accordance with the result obtained by causing the data converting means to convert the measured data obtained when the display means displays the lowest gray scale of white.

With the above arrangement, in which the target output brightness corresponding to the intermediate gray scale value is adjusted in consideration of the characteristic of the display (black state) of the lowest gray scale of the white on the display means, it is possible to avoid that target output brightness actually indisplayable on the display means is set.

It is preferable that the correction characteristic determining device according to the present invention, having the gray scale adjusting means, is arranged so that the intermediate gray scale values include a lowest gray scale value of white, and as to each of the primary color signals, the gray scale adjusting means subtracts the result, obtained by causing the data converting means to convert the measured data obtained when the display means displays the lowest gray scale of white, from the target output brightness corresponding to the lowest gray scale of white that has been determined by the intermediate gray scale determining means, so as to obtain an adjustment parameter of the primary color signal, and the gray scale adjusting means subtracts the adjustment parameter of the primary color signal from at least indisplayable target brightness so as to perform adjustment, the indisplayable target brightness being part of the target brightness corresponding to the intermediate gray scales determined by the intermediate gray scale determining means.

With this arrangement, it is possible to adjust the target output brightness corresponding to the lowest gray scale of white, to the lowest output brightness actually displayable on the display means. Because of this, it becomes possible to effectively utilize the low gray scale area that is actually displayable on the display means, thereby avoiding that actually indisplayable target output brightness is set.

It is preferable that the correction characteristic determining device according to the present invention, performing adjustment by subtracting the adjustment parameter, is arranged so that the gray scale adjusting means performs the adjustment with respect to part of the intermediate gray scale values, and the part is not more than a threshold value which is set as an upper limit of the gray scale that should be adjusted.

With the above arrangement, the threshold is appropriately set so as to smoothly transit from the area in which the target output brightness is adjusted, to the area in which the target output brightness is not adjusted. Thus, it is possible to prevent the color and the brightness from being significantly varied due to a slight differences in the gray scales when a dim image is displayed on the display means.

It is preferable that the correction characteristic determining device according to the present invention, having the intermediate gray scale determining means, further includes gray scale value converting means for determining corrected gray scale values, corresponding to the highest gray scale values of the respective primary color signals and the plurality of intermediate gray scale values of the respective primary color signals, in accordance with (a) the target output brightness and (b) the result obtained by causing the data converting means to convert the measured data obtained when the display means displays the highest gray scale of white.

With the above arrangement, it is possible to determine the corresponding relationship between the gray scale of the image signal and thus corrected value gray scale value corresponding to that grays scale. By offering the corresponding relationship to the display apparatus, it is possible to enable the display means to perform the correction with ease.

Note that, each of the correction characteristic determining devices according to the present invention can be regarded also as a correction characteristic determining method. Also in the following correction characteristic determining method, it is possible to obtain the same effects as in the foregoing correction characteristic determining devices.

That is, the correction characteristic determining method according to the present invention is to determine a correction characteristic in a display device which corrects an image signal constituted of three primary color signals, and displays a color image in display means in accordance with thus corrected image signal, and said method includes the steps of: (i) converting measured data, convertible into a tristimulus value, that indicates a result of measurement performed with respect to an emission condition of display in the display means, into brightness data of three primary colors, by using a conversion matrix; (ii) determining the correction characteristic in accordance with a conversion result obtained by the step (i); and (iii) generating the conversion matrix before performing the step (i), wherein the step (iii) includes the steps of: (iii-a) generating a matrix element of an inverse matrix of the conversion matrix, in accordance with measured data obtained when the display means displays highest gray scales of respective primary colors; (iii-b) adjusting a matrix element that has been generated by the step (iii-a) in accordance with measured data obtained when the display means displays a highest gray scale of white; and (iii-c) generating an inverse matrix of a matrix constituted of the matrix element that has been adjusted.

Further, it is preferable that the method according to the present invention, described above, further includes the step of (iv) generating a mixture ratio of output brightness of the three primary colors, by converting target chromaticity data, convertible into a tristimulus value, that indicates target chromaticity required in setting display chromaticity in the display means, in accordance with the conversion matrix, wherein the step (ii) includes the step of (ii-a) determining target output brightness, corresponding to the highest gray scales of the respective primary color signals of the image signal, in accordance with (a) a result obtained by causing the data converting means to convert the measured data obtained when the display means displays the highest gray scale of white and (b) the target mixture ratio.

Further, it is preferable that the method according to the present invention, having the step (ii-a), is arranged so that the step (ii) is such that, in accordance with (a) a ratio of brightness data of the respective primary colors that has been obtained by causing the data converting means to convert the measured data obtained when the display means displays the highest gray scale of white, and (b) the target mixture ratio, the brightness data of one primary color signal, being shortest, is regarded as the target output brightness corresponding to the highest gray scale value of the primary color signal, and the target output brightness is regarded as a reference value so as to determine other target output brightness corresponding to highest gray scale values of other primary color signals in accordance with the target mixture ratio.

Further, it is preferable that the method according to the present invention, having the step (ii-a), is arranged so that the step (ii) includes the step of (ii-b) determining the target output brightness, corresponding to the intermediate gray scale values of the respective primary color signals, in accordance with (a) the target output brightness corresponding to the highest gray scale values of the respective primary color signals that have been determined by the highest gray scale determining means, and (b) a ratio of the target output brightness corresponding to the highest gray scale value that has been set in the display means and the target output brightness respectively corresponding to a plurality of intermediate gray scale values.

Further, it is preferable that the method according to the present invention, having the step (ii-b), is arranged so that, in the display means, a relationship between gray scale values of the respective primary color signals and output brightness is such that density of gray scale values employed as the intermediate gray scale values is made higher at a gray scale value area, at which variation of the output brightness is relatively small with respect to variation of the gray scale value, than at a gray scale value area, at which the variation of the output brightness is relatively large with respect to the variation of the gray scale value.

Further, it is preferable that the method according to the present invention, having the step (ii-b), is arranged so that the step (ii) includes the step of (ii-c) adjusting the target output brightness corresponding to the intermediate gray scale values of the respective primary color signals, that have been determined by the intermediate gray scale determining means, in accordance with the result obtained by causing the data converting means to convert the measured data obtained when the display means displays the lowest gray scale of white.

Further, it is preferable that the method according to the present invention, having the step (ii-c), is arranged so that the intermediate gray scale values include a lowest gray scale value of white, and the step (ii-c) is such that, as to each of the primary color signals, the result, obtained by causing the data converting means to convert the measured data obtained when the display means displays the lowest gray scale of white, is subtracted from the target output brightness corresponding to a lowest gray scale of white that has been determined by the intermediate gray scale determining means, so as to obtain an adjustment parameter of the primary color signal, and the adjustment parameter of the primary color signal is subtracted from at least indisplayable target brightness so as to perform adjustment, the indisplayable target brightness being part of the target brightness corresponding to the intermediate gray scales determined by the intermediate gray scale determining means.

Further, it is preferable that the method according to the present invention, in which the adjustment is performed by subtracting the adjustment parameter, is arranged so that the step (iii) is such that the adjustment is performed with respect to part of the intermediate gray scale values, and the part is not more than a threshold value which is set as an upper limit of the gray scale that should be corrected.

Further, the method according to the present invention, having the step (ii-b), in which the adjustment is performed by subtracting the adjustment parameter, further includes the step of determining corrected gray scale values, corresponding to the highest gray scale values of the respective primary color signals and the intermediate gray scale values of the respective primary color signals, in accordance with (a) the target output brightness and (b) the result obtained by causing the data converting means to convert the measured data obtained when the display means displays the highest gray scale of white.

Further, the display device according to the present invention corrects an image signal constituted of three primary color signals, and displays a color image in display means in accordance with thus corrected image signal, and a correction characteristic of said display device is determined by the correction characteristic determining method. In the display device, it is possible to appropriately determine the correction characteristic by using the correction characteristic determining device, thereby realizing a high-quality display.

Further, the display device which corrects an image signal constituted of three primary color signals, and displays a color image in display means in accordance with thus corrected image signal, and said display device includes: storage means for storing corrected gray scale values determined by the correction characteristic determining device having the gray scale converting means; and signal converting means for converting the image signal into the corrected image signal in accordance with the corrected gray scale values that have been stored in the storage means.

In the display device, it is possible to appropriately determine the correction characteristic by using the correction characteristic determining device, thereby realizing a high-quality display.

It is preferable that the display device according to the present invention, described above, is arranged so that the signal converting means generates the corrected image signal by interpolating the corrected gray scale values, that have been stored, corresponding to the image signal.

With the above arrangement, it is possible to calculate out, by performing the interpolation, the gray scale value other than the gray scale employed as the plurality of the intermediate gray scale values. Therefore, it becomes possible to maintain a high-quality display with a fewer number of the gray scale values employed as the plurality of the intermediate gray scale values. Therefore, it becomes possible to reduce the capacity of the storage means.

The correction characteristic determining device according to the present invention determines a correction characteristic of a display device which corrects an image signal constituted of three primary color signals, and displays a color image in display means in accordance with thus corrected image signal, and said correction characteristic determining device includes: target curve setting means for setting a target curve indicative of a relationship between a gray scale value of the image signal that has not been corrected and target output brightness, corresponding to the gray scale value, that should be displayed in the display means; gray scale adjusting means for setting an adjustment parameter by subtracting an actual brightness value, obtained when the display means displays a lowest gray scale, from lowest target output brightness corresponding to a lowest gray scale value of the image signal in the target curve, and for correcting the target curve by subtracting the adjustment parameter from at least target output brightness less than the lowest target output brightness; and gray scale value converting means for determining a relationship between the gray scale value, that has not been corrected, and the gray scale value, that has been corrected, in the image signal, in accordance with the target curve that has been adjusted by the gray scale correcting means.

With the above arrangement, in which the target output brightness corresponding to the intermediate gray scale value is adjusted in consideration of the characteristic of the display (black state) of the lowest gray scale of the white on the display means, it is possible to avoid that target output brightness actually indisplayable on the display means is set. Here, this arrangement makes it possible to adjust the lowest target output brightness corresponding to the lowest gray scale, to the lowest output brightness actually displayable on the display means. Because of this, it becomes possible to effectively utilize the low gray scale area that is actually displayable on the display means, thereby avoiding that actually indisplayable target output brightness is set.

It is preferable that the correction characteristic determining device described above is arranged so that the gray scale correcting means performs the adjustment with respect to a gray scale, not more than a threshold value, that has been set as an upper limit of the gray scale value that should be subjected to the adjusted.

With the above arrangement, the threshold is appropriately set so as to smoothly transit from the area at which the target output brightness is adjusted, to the area at which the target output brightness is not adjusted. Thus, it is possible to prevent the color and the brightness from being significantly varied due to a slight differences in the gray scales when a dim image is displayed on the display means.

Further, the correction characteristic determining method according to the present invention is to determine a correction characteristic in a display device which corrects an image signal constituted of three primary color signals, and displays a color image in display means in accordance with thus corrected image signal, said method comprising the steps of: (I) setting a target curve indicative of a relationship between a gray scale value of the image signal that has not been corrected and target output brightness that should be displayed in the display means; (II) setting an adjustment parameter by subtracting an actual brightness value, obtained when the display means displays a lowest gray scale, from lowest target output brightness corresponding to a lowest gray scale value of the image signal in the target curve, so as to adjust the target curve by subtracting the adjustment parameter from at least target output brightness less than the lowest target output brightness; and (III) determining a relationship between the gray scale value, that has not been corrected, and the gray scale value, that has been corrected, in the image signal, in accordance with the target curve that has been adjusted by the step (II).

It is preferable that the method according to the present invention, described above, is arranged so that the step (III) is such that the adjustment is performed with respect to a gray scale, not more than a threshold value, that has been set as an upper limit of the gray scale value that should be subjected to the adjustment.

Further, the display device according to the present invention corrects an image signal constituted of three primary color signals, and displays a color image in display means in accordance with thus corrected image signal, and a correction characteristic of said display device is determined by the correction characteristic determining method.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A correction characteristic determining device for determining a correction characteristic in a display device which corrects an image signal, and displays an image in display means in accordance with thus corrected image signal, said correction characteristic determining device comprising:

target curve setting means for setting a target curve indicative of a relationship between a gray scale value of the image signal that has not been corrected and target output brightness, corresponding to the gray scale value, that should be displayed in the display means;

gray scale adjusting means for setting an adjustment parameter by subtracting an actual brightness value, obtained when the display means displays a lowest gray scale, from lowest target output brightness corresponding to a lowest gray scale value of the image signal in the target curve, and for adjusting the target curve by subtracting the adjustment parameter from at least target output brightness in the target curve which is less than the actual brightness value; and gray scale value converting means for determining a relationship between the gray scale value, that has not been corrected, and the gray scale value, that has been corrected, in the image signal, in accordance with the target curve that has been adjusted by the gray scale adjusting means.

2. The correction characteristic determining device as set forth in claim 1, wherein the gray scale correcting means performs the adjustment with respect to a gray scale, not more than a threshold value, that has been set as an upper limit of the gray scale value that should be subjected to the adjusted.

3. The correction characteristic determining device of claim 1, wherein the adjustment parameter is intrinsic to the display device.

4. The correction characteristic determining device of claim 1, wherein the adjustment parameter is equal to the lowest target output brightness minus the actual brightness value.

5. A correction characteristic determining method for determining a correction characteristic in a display device which corrects an image signal, and displays an image in display means in accordance with thus corrected image signal, said method comprising:

(I) setting a target curve indicative of a relationship between a gray scale value of the image signal that has not been corrected and target output brightness that should be displayed in the display means;

(II) setting an adjustment parameter by subtracting an actual brightness value, obtained when the display means displays a lowest gray scale, from lowest target output brightness corresponding to a lowest gray scale value of the image signal in the target curve, so as to adjust the target curve by subtracting the adjustment parameter from at least target output brightness in the target curve which is less than the actual brightness value;

(III) determining a relationship between the gray scale value, that has not been corrected, and the gray scale value, that has been corrected, in the image signal, in accordance with the target curve that has been adjusted by the step (II); and (IV) at least one of (a) displaying an image in the display means in accordance with the relationship determined in step (III), and (b) storing information representing the relationship determined in step (III) in a storage means.

6. The method as set forth in claim 5, wherein the step (III) is such that the adjustment is performed with respect to a gray scale, not more than a threshold value, that has been set as an upper limit of the gray scale value that should be subjected to the adjustment.

7. The method of claim 5, wherein the adjustment parameter is intrinsic to the display device.

8. The method of claim 5, wherein the adjustment parameter is equal to the lowest target output brightness minus the actual brightness value.

9. A display device which corrects an image signal, and displays an image in display means in accordance with thus corrected image signal, a correction characteristic in said display device being determined by a correction characteristic determining method, wherein said method comprises:

(I) setting a target curve indicative of a relationship between a gray scale value of the image signal that has not been corrected and target output brightness that should be displayed in the display means;

(II) setting an adjustment parameter by subtracting an actual brightness value, obtained when the display means displays a lowest gray scale, from lowest target output brightness corresponding to a lowest gray scale value of the image signal in the target curve, so as to adjust the target curve by subtracting the adjustment parameter from at least target output brightness less than the actual brightness value; and (III) determining a relationship between the gray scale value, that has not been corrected, and the gray scale value, that has been corrected, in the image signal, in accordance with the target curve that has been adjusted by the step (II).

10. The method of claim 9, wherein the adjustment parameter is intrinsic to the display device.

11. The method of claim 9, wherein the adjustment parameter is equal to the lowest target output brightness minus the actual brightness value.

* * * * *